US010562696B2

(12) United States Patent
Yeo

(10) Patent No.: US 10,562,696 B2
(45) Date of Patent: Feb. 18, 2020

(54) CONTAINER FOR STORING AND INDIVIDUALLY DISCHARGING CAPSULES

(71) Applicant: Toly Korea Inc., Bucheon-si, Gyeonggi-do (KR)

(72) Inventor: Soo Bin Yeo, Bucheon-si (KR)

(73) Assignee: TOLY KOREA INC., Bucheon-si (KR)

( * ) Notice: Subject to any disclaimer, the term of this patent is extended or adjusted under 35 U.S.C. 154(b) by 0 days.

(21) Appl. No.: 15/378,618

(22) Filed: Dec. 14, 2016

(65) Prior Publication Data

US 2017/0183143 A1 Jun. 29, 2017

(30) Foreign Application Priority Data

Dec. 24, 2015 (KR) ..... 10-2015-0185530
May 26, 2016 (KR) ..... 10-2016-0065021

(51) Int. Cl.
*B65D 83/04* (2006.01)

(52) U.S. Cl.
CPC .... *B65D 83/0409* (2013.01); *B65D 2583/049* (2013.01)

(58) Field of Classification Search
CPC ... A61J 7/0084; B65D 83/0011; B65D 83/04; B65D 83/0409; B65D 83/0454
See application file for complete search history.

(56) References Cited

U.S. PATENT DOCUMENTS 2,693,873 A * 11/1954 Martin ..... B65G 33/12 198/670
3,176,535 A * 4/1965 Rowland ..... F16H 25/2223 74/424.83
3,715,055 A * 2/1973 Kendrick et al. ..... B65G 53/30 221/75
4,560,086 A * 12/1985 Stol ..... B65D 83/0409 198/724
4,887,816 A * 12/1989 Hanna ..... A63F 7/048 273/144 A (Continued)

FOREIGN PATENT DOCUMENTS

CA 1088859 11/1980
FR 1200571 12/1959

(Continued)

OTHER PUBLICATIONS

International Search Report mailed in corresponding application PCT/KR2016/00790 dated Sep. 23, 2016.

*Primary Examiner* — Gene O Crawford
*Assistant Examiner* — Kelvin L Randall, Jr.
(74) *Attorney, Agent, or Firm* — Wissing Miller LLP

(57) ABSTRACT

A container for storing capsules and discharging them individually, including an upwardly open capsule-holding receptacle, a cap rotatably mounted on the receptacle, an upright screw shaft with an external spiral groove fixedly mounted in the receptacle, and a hollow cylinder concentrically surrounding the screw shaft within the receptacle and coupled to the cap for rotation therewith. A thread on the inner surface of the cylinder faces and cooperates with the spiral groove to receive capsules admitted from the receptacle through an entry port in the cylinder and, as the cap is rotated, to raise the admitted capsules one by one to a central discharge port in the cap.

11 Claims, 20 Drawing Sheets

(56) References Cited

U.S. PATENT DOCUMENTS

| | | | | |
|---|---|---|---|---|
| 4,965,951 | A * | 10/1990 | Miller | F41A 9/77 42/49.01 |
| 5,213,232 | A | 5/1993 | Kraft et al. | |
| 5,542,570 | A * | 8/1996 | Nottingham | G07F 11/44 221/192 |
| 5,592,760 | A | 1/1997 | Kohout | |
| 5,884,806 | A * | 3/1999 | Boyer | A61J 7/02 221/13 |
| 6,860,403 | B1 | 3/2005 | Mehrens et al. | |
| 7,204,391 | B2 | 4/2007 | Toker | |
| 7,314,131 | B2 * | 1/2008 | Olds | B65G 33/20 198/658 |
| 8,727,180 | B2 | 5/2014 | Zonana et al. | |
| 9,501,626 | B2 * | 11/2016 | Zhang | G06F 19/3462 |
| 2005/0189373 | A1 * | 9/2005 | Aylward | B65B 5/103 221/236 |
| 2006/0086592 | A1 * | 4/2006 | Olds | B65G 33/20 198/658 |
| 2008/0099310 | A1 * | 5/2008 | Olds | B65G 33/20 198/671 |
| 2011/0120354 | A1 * | 5/2011 | Riemens | F23B 40/04 110/327 |
| 2014/0353327 | A1 * | 12/2014 | Bae | G07F 11/24 221/7 |
| 2015/0001245 | A1 | 1/2015 | Kroll et al. | |
| 2015/0266654 | A1 | 9/2015 | Baarman et al. | |
| 2016/0120760 | A1 * | 5/2016 | Nazginov | A61J 7/0481 215/230 |

FOREIGN PATENT DOCUMENTS

| | | |
|---|---|---|
| JP | 2001-048287 | 2/2001 |
| JP | 3075575 | 2/2001 |
| KR | 10-1998-0709364 | 11/1998 |
| KR | 20030021454 | 3/2003 |
| KR | 20-2003-0021454 | 7/2003 |
| KR | 20-2003-0027827 | 8/2003 |
| KR | 20-2008-0003947 | 9/2008 |
| KR | 10-20110076853 | 7/2011 |
| KR | 20110076853 | 7/2011 |
| KR | 10-1202811 | 11/2012 |
| KR | 10-1342843 | 12/2013 |
| KR | 20140141277 | 12/2014 |
| WO | 2000/064783 | 11/2000 |
| WO | 2011/154448 | 12/2011 |

* cited by examiner

CONTAINER FOR STORING AND INDIVIDUALLY DISCHARGING CAPSULES

CROSS REFERENCE TO RELATED APPLICATIONS

This application claims the right to priority, under 35 U.S.C. § 119(a), of Republic of Korea patent applications Nos. KR 10-20150185530 filed Dec. 24, 2015, and KR 10-20160065021 filed May 26, 2016, the disclosures of both being incorporated herein by this reference.

BACKGROUND OF THE INVENTION

This invention relates to containers for storing capsules, and more particularly to such containers providing discharge of capsules individually, i.e., one by one.

A variety of products, including cosmetics, drugs, foods, detergents and the like, are commonly prepared in the form of capsules, which are packaged in bottles or other containers for storage and sale. In general, a capsule container includes a body constituting a receptacle for holding a plurality of capsules, and a lid for closing the receptacle. To obtain one or more capsules from the container, a user may take off the lid and tilt the open receptacle to cause capsules to fall out, or reach into the receptacle to remove capsules with the fingers.

Such operations present problems, however, in that when the open receptacle is tilted, an undesired excess of capsules may come out, while manual extraction of capsules from within the receptacle is not easily accomplished. In either case, there is a danger that capsules not intended to be withdrawn may be contaminated by contact with surfaces outside the container or with the user's fingers inside the container. Additionally, if the capsules are of low strength (as are some cosmetic capsules), attempted extraction with the fingers may subject them to breakage.

Expedients for overcoming these difficulties have heretofore been proposed, for example in Republic of Korea registered utility model No. 20-0334691 and Republic of Korea patent No. 10-1342843. The proposed expedients, however, do not entirely prevent discharge of more than one capsule at a time, may exert pressure sufficient to cause breakage of low-strength cosmetic capsules, and may require inconveniently complex manipulation.

SUMMARY OF THE INVENTION

An object of the invention is to provide a capsule container that discharges capsules individually, i.e., one by one, reliably and with manipulative simplicity. Another object is to provide such a container that does not exert crushing pressure on capsules incident to discharge.

To these and other ends, the present invention broadly contemplates the provision of a capsule container for storing plural capsules and discharging the stored capsules individually, comprising an upwardly open container body including a receptacle portion for holding a plurality of capsules; a cap mounted on the container body for manual rotation relative thereto about a vertical axis and having a discharge port; an upright screw shaft disposed within and fixedly secured to the receptacle portion and having a circumferential spiral groove; and a hollow cylinder coupled to the cap for rotation therewith, extending downwardly from the cap through the receptacle portion in surrounding concentric relation to the screw shaft, the cylinder having an inner surface bearing a screw thread facing the spiral groove, a lower part of the cylinder having an entry port for admitting stored capsules from the receptacle portion individually into the cylinder, and the cylinder communicating upwardly with the discharge port, wherein the thread and the groove are coaxial and are mutually dimensioned and configured to receive between them an individual capsule admitted into the cylinder through the entry port and, upon rotation of the cap in a particular direction relative to the container body, to cause admitted capsules to be raised one by one from the entry port to the discharge port.

The container body may include a main body portion joined to a lower part of the receptacle portion. The spiral groove and the screw thread have opposite senses of rotation, and the screw shaft may have an upper end exposed above the hollow cylinder. In addition, the hollow cylinder advantageously includes a capsule inflow guide protruding outwardly from the cylinder on one side of the entry port; and the container may have a container lid mounted over the cap. Multiple first interlocking protrusions may be formed on the cap and multiple second interlocking protrusions may be formed on the cylinder for coupling with the first interlocking protrusions so that the cylinder rotates with the cap. The container may also include a first ratchet gear provided on the container body and a second ratchet gear provided on the cap, wherein the first and second gears interlock to restrict rotation of the cap about the vertical axis to the aforesaid particular direction.

Further embodiments of the invention include features for addressing the following problems: If, when a capsule is discharged, only a part of the capsule is exposed at the top of the hollow cylinder and the screw shaft, a user must grasp a small-sized capsule carefully with the fingers, which is inconvenient and problematical. When the receptacle contains multiple capsules, the weight of capsules pressing down on those capsules at the level of the entry port may cause more than one capsule to enter the cylinder at the same time. Also, if a capsule does not flow readily by friction with the bottom surface of the receptacle or vessel when the hollow cylinder is rotated, the capsule may become pressed into the capsule inflow guide protruding from the cylinder, resulting in waste of the capsule and dirtying of the interior of the receptacle.

To avoid such problems, these further embodiments of the invention include a discharge cover provided with a discharge outlet (port) centrally disposed on the cap on the capsule-holding vessel (receptacle), so that when the cap and cylinder are rotated and capsules move from the receptacle through the entry port into the rotating cylinder, the capsules are raised upwardly by the spiral groove of the screw shaft and the thread of the cylinder and are easily discharged one by one to the upper surface of the cap through the discharge port of the discharge cover. The entry port of the cylinder is provided with a capsule inflow guide protruding outwardly from one side of the port and an upper cover protruding outwardly from the top of the entry port. In addition, an anti-friction part may be formed on the bottom of the receptacle. With the spiral groove of the screw shaft and the thread of the cylinder having opposite senses of rotation, each capsule is easily introduced into the rotating cylinder through the entry port as it naturally moves when the cap rotates, and follows the spiral of the cylinder thread at the point of intersection of the thread and the spiral groove of the screw shaft, advancing smoothly upward to the discharge cover and discharge port on the cap.

Again the container may include a main container body coupled to the exterior of the vessel (receptacle). Moreover, a first sealing ring may be formed on the inside of the vessel or receptacle so as to be in close contact with the inner periphery of the vessel. The container may also have a vessel lid removably mounted in a closed position on the vessel, the lid having a second sealing ring of elastic material formed on the inside of the vessel lid so as to be in close contact with a top surface of the cap when the vessel lid is in the closed position, such that at times of carrying or storage of the container, the sealing force on the inside of the vessel is improved. Furthermore, a sealing driver may be formed in close contact with the second sealing ring of the vessel lid on the top surface of the rotary cap. A slope may be formed on the lower side of the discharge port so that capsules can be naturally discharged from the discharge port.

Terms such as "upwardly," "downwardly," "upper," "lower," "vertically," "horizontally," "top," "bottom" and the like, as used herein, will be understood to refer to positions, directions and orientations subsisting when the container is standing upright on a table.

Further features and advantages of the invention will be apparent from the detailed description set forth below, together with the accompanying drawings.

DETAILED DESCRIPTION

Figure 7:
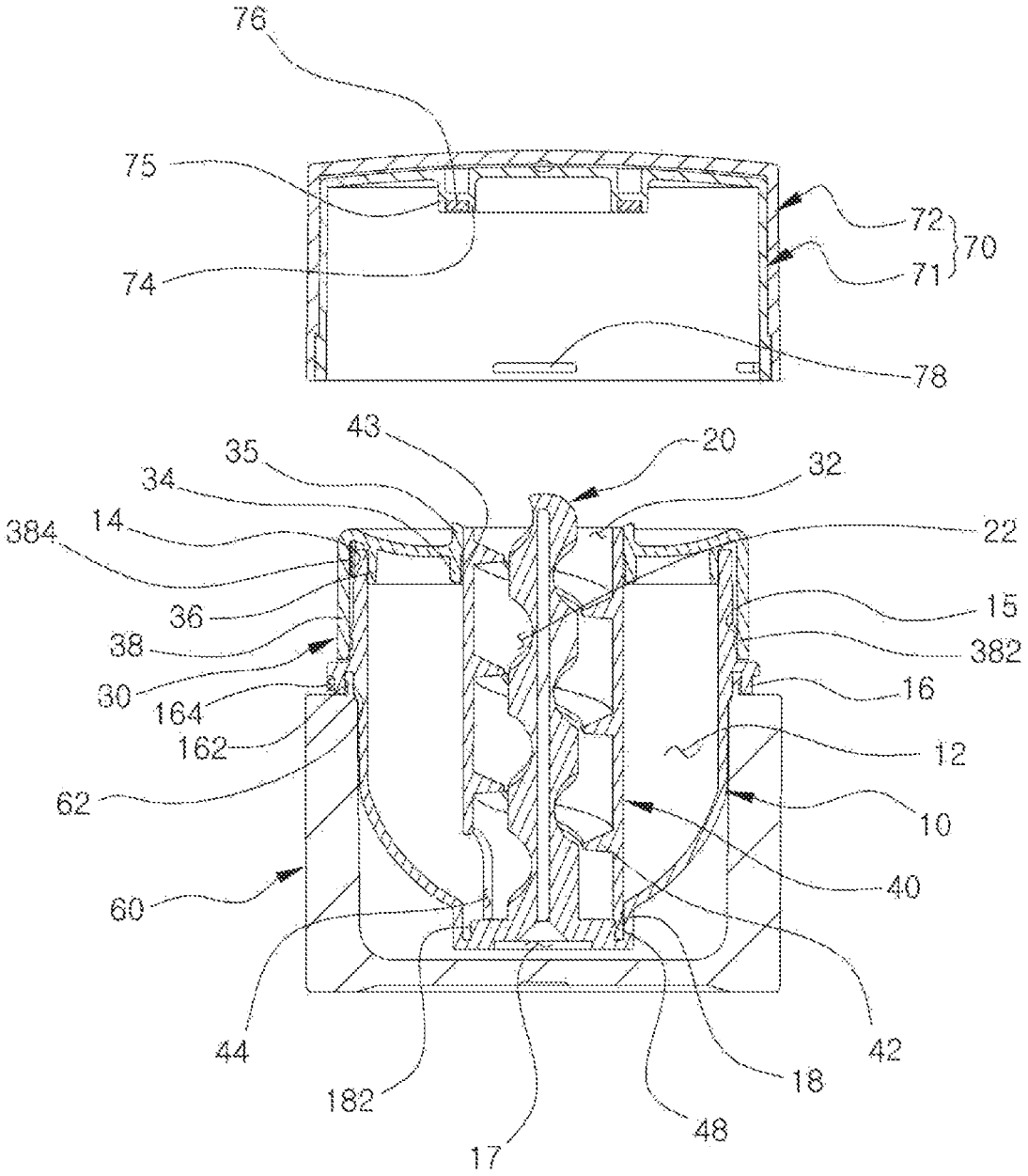
FIG. 7 is a sectional elevational view of a modified embodiment of the capsule container of the invention.

An illustrative embodiment of the capsule container of the present invention is shown in FIGS. 1-6, and a modification thereof is shown in FIG. 7.

This embodiment includes a container body having a receptacle portion in which a plurality of capsules are internally stored. A screw shaft having a spiral groove formed on its outer circumference is fixed and bonded in the center of the interior of the container; a rotary cap is rotatably coupled to the upper side of the container; a rotary hollow cylinder having a screw thread formed on its inner periphery is coupled to the lower side of the center of the rotary cap and is disposed outside and in surrounding concentric relation to the screw shaft; an entry port is formed on one side of the lower part of the cylinder; and a discharge port is formed at the center of the upper part of the rotary cap. Thereby when the rotary cap is rotated, the rotary cylinder is rotated, the capsules contained in the interior of the container (receptacle portion) are caused to enter the entry port of the rotary cylinder, and thereafter, caused to move upwards by the thread of the rotary cylinder and the spiral groove of the screw shaft, enabling ready discharge of capsules one by one through the discharge port of the rotary cap.

Moreover, a capsule inflow guide is protrusively formed on one side of the entry port of the rotary cylinder, so that when the rotary cap is rotated, the capsules contained in the receptacle portion are easily caused to flow into the inside of the rotary cylinder; and the spiral groove of the screw shaft and the thread of the rotary cylinder are formed with mutually opposite directions (senses of rotation) so thereby the capsules are smoothly carried upwards at the point of intersection between the spiral grooves of the screw shaft and the threads of the rotary cylinder. A container main body is coupled to the lower parts of the container, and a container lid is provided on the top part of the rotary cap. A sealing ring is attached to the inside of the top parts of the container lid.

Stated with more particular reference to FIGS. 1-6, the container therein shown is constructed as a capsule container having a receptacle 10 in which a multiplicity of capsules 50 are internally stored, a screw shaft 20 which is fixed and bonded in the center of the interior of the container receptacle portion 10, a rotary cap 30 which is coupled rotatably with the upper side of the container 10 and formed with a discharge port 32 in the center, and a rotary hollow cylinder 40 which is coupled to the lower side of the center of the rotary cap 30 and is disposed on the outside of the screw shaft 20 in concentric surrounding relation thereto. The hollow cylinder is formed with an entry port 44 on one side at its lower part. A spiral groove 22 is formed on the outer circumference of the screw shaft 20 and a thread 42 is formed on the inner circumference (inner surface) of the rotary cylinder.

Inside the container receptacle 10 is a capsule storage space 12 wherein the capsules 50 (shown as spherical) are stored. The contents of the capsules 50 stored in container receptacle 10 may be cosmetics, tablets, gum or the like, for example cosmetic capsules; the term "cosmetic capsules" herein refers to capsules formed of bead-shaped thin film wherein a gel- or liquid-form cosmetic material is filled within the capsules, and the contents filling the inside of the capsules are discharged by breaking the thin film for use.

A toothed first ratchet gear 14, rotatable in just one direction, is formed on the outer circumference of the upper part of the capsule container 10. A first fastening protruding ring 15, to which the rotary cap 30 is coupled in an undercut manner, is also formed on the outer circumference of the container 10. A lower extending protruding ring 16 which protrusively extends is formed on the lower side of the first fastening protruding ring 15, a first mounting protruding ring 162 is formed in an inwardly extending manner on the inner circumference of the lower extending protruding ring 16, and an open-and-closure groove 164 is formed on one side of the outer circumference.

The internal bottom surface of the container receptacle 10 is concave in form, and a through-hole 17 through which the screw shaft 20 penetrates from underneath is formed in the center of the bottom surface. An installation groove 18 into which the rotary hollow cylinder 40 couples (i.e., in which the circular lower end of cylinder 40 is rotatably received, for support and stabilization of the cylinder by the receptacle) is formed outside the through-hole 17, and an installation protruding ring 182 is formed in the inner bottom surface of the receptacle on the internal side surface of the installation groove 18.

The screw shaft 20 is fixed in the center of the interior of the container 10, being inserted from underneath into the through-hole 17 in the center of the container 10, and is forcibly fitted to the through-hole 17 by multiple interlocking protrusions 24 formed on the outer circumference on the lower side of the screw shaft 20.

A spiral groove 22 is formed on the outer circumference (outer surface) of the screw shaft 20, and the top part of the screw shaft 20 is exposed out above the rotary cylinder 40. Since the screw shaft 20 thus extends higher than the cylinder 40, the capsules 50 discharged from the container are completely exposed from the cylinder 40 by the screw shaft 20.

Figure 1:
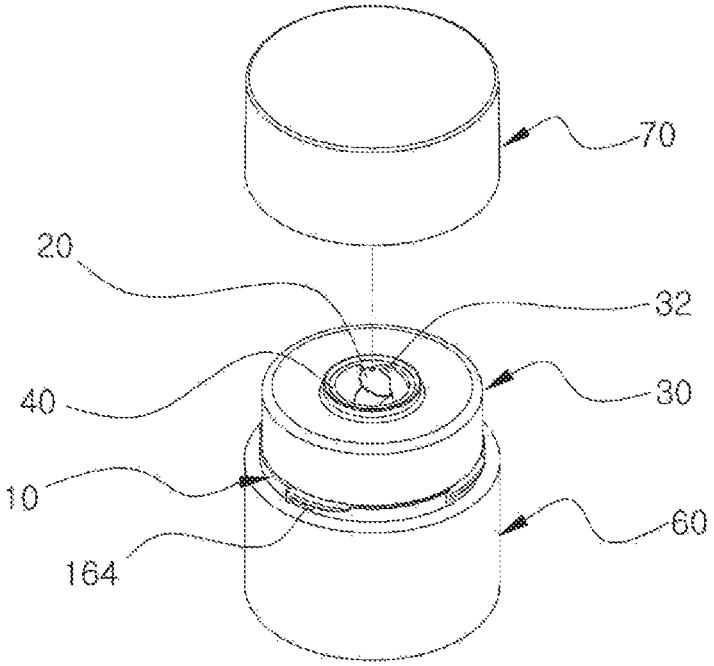
FIG. 1 is a perspective view of a capsule container embodying the present invention in a particular form.
Figure 2:
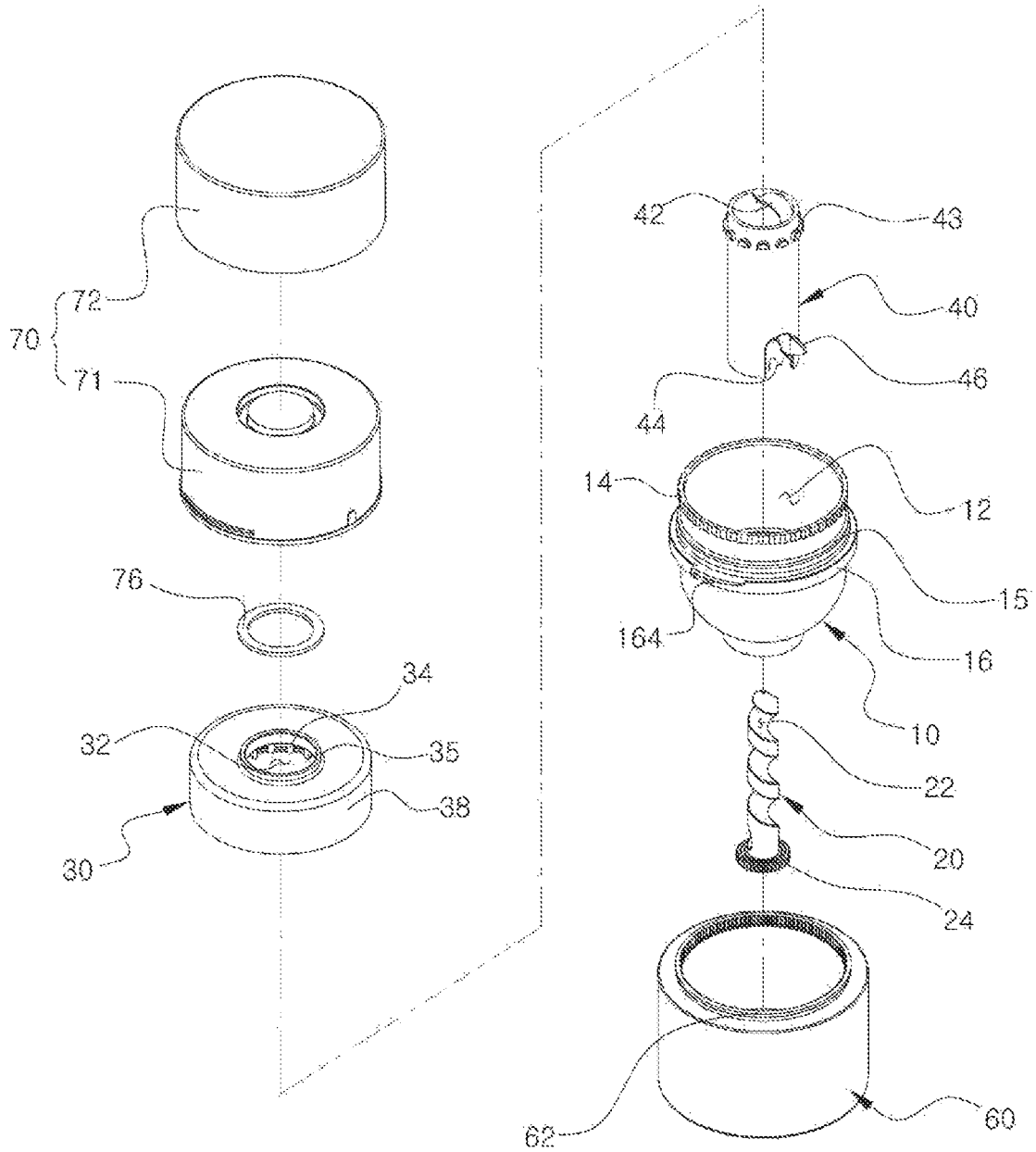
FIG. 2 is an exploded perspective view of the capsule container of FIG. 1.
Figure 3:
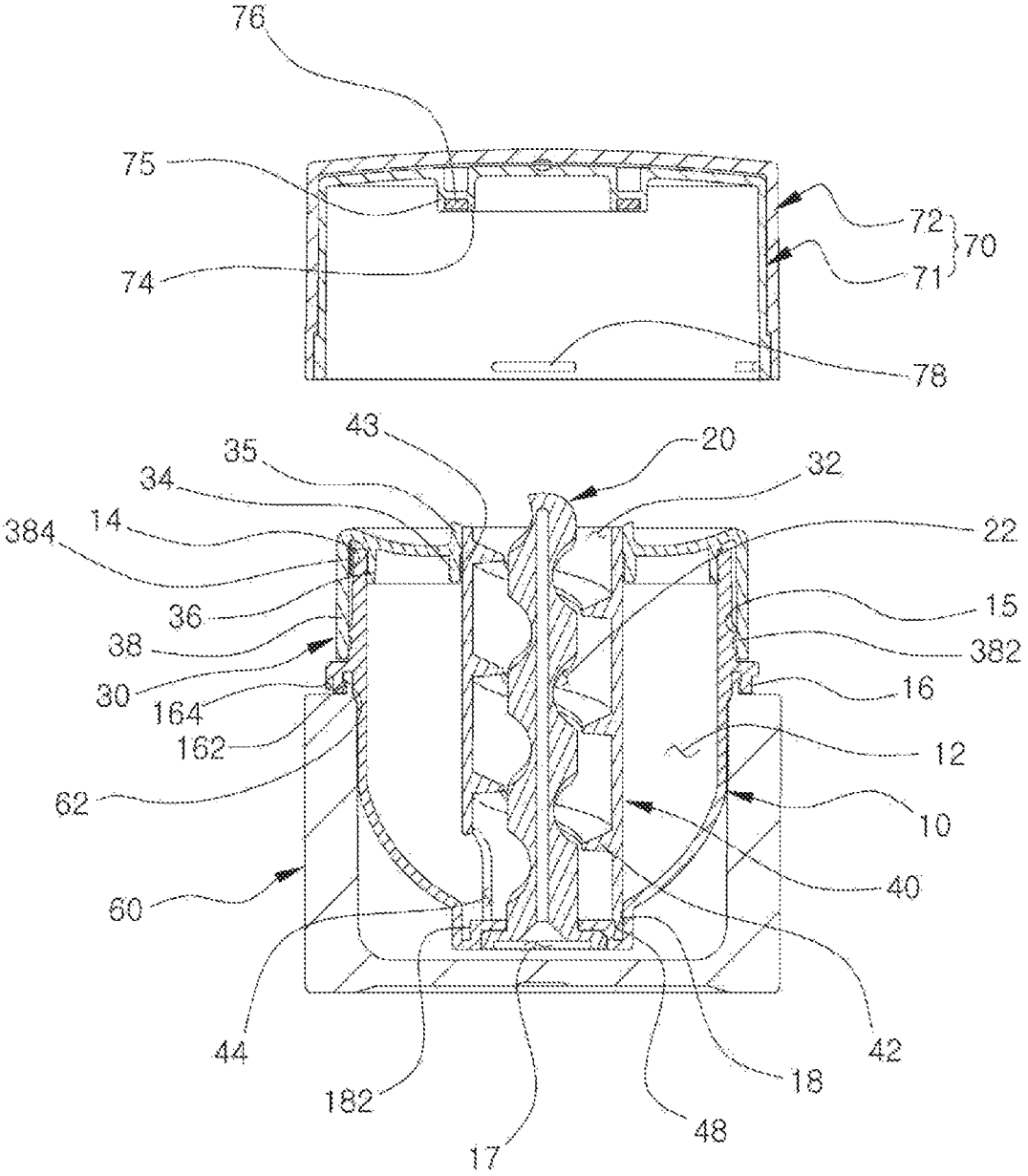
FIG. 3 is a sectional elevational view of the capsule container of FIG. 1, showing the lid separated from the top.

As an alternative to the above-described mounting of the screw shaft 20 in the container 10, the screw shaft 20 can be integrally formed in the center of the bottom surface of the container receptacle 10, in the modified embodiment illustrated in FIG. 7, which may in other respects be essentially identical to that of FIGS. 1-6; in FIGS. 3 and 7, like reference numerals indicate like features and elements.

Referring further to FIGS. 1-6, a container main body 60 that holds the container receptacle portion 10 is attached to the lower part of portion 10. A second mounting protruding ring 62 formed on the top outer circumference of the container main body 60 couples in an undercut manner with the first mounting protruding ring 162 of the container receptacle portion 10.

The cap 30 is coupled rotatably with the upper sides of the container 10 and has a discharge port 32, from which the capsules are discharged, formed in the center. A plurality of first interlocking protrusions 34 that are coupled to the cylinder 40 are formed extending downwards on the outside of the discharge port 32 of the cap 30, an inner wall 36 in close contact with the upper inner circumference of the container 10 is formed extending downwards on the outside of the first interlocking protrusions 34, and an outer wall 38 is formed extending downwards on the outside of the inner wall 36.

An upper extending protruding ring 35 is formed extending upwards above the first interlocking protrusions 34. A second fastening protruding ring 382, formed on the bottom inner circumference of the outer wall 38, is coupled in an undercut manner with the first fastening protruding ring of the container 10.

A second ratchet gear 384 that interlocks with the first ratchet gear 14 of the container 10 is formed on the top inner circumference of the outer wall 38. Accordingly, the rotary cap 30 rotates in just one direction with respect to the container 10, and reverse rotation is prevented. Furthermore, when the cap 30 is rotated, a sound is created while the second ratchet gear 384 of the cap slides over the first ratchet gear 14 of the container 10 so as to alert the user that capsules 50 are being raised.

The cylinder 40 is coupled to the underside of the cap 30 in the center, and is also disposed on the outside of the screw shaft 20, in concentric surrounding relation thereto. A plurality of second interlocking protrusions 43, formed on the top outer circumference of the rotary cylinder 40, couple with the first interlocking protrusions 34 of the rotary cap 30 such that when the cap 30 is rotated while the second interlocking protrusions are interlocked with the first interlocking protrusions 34, the cylinder 40 does not remain static but rotates together with the cap 30.

Figure 4A:
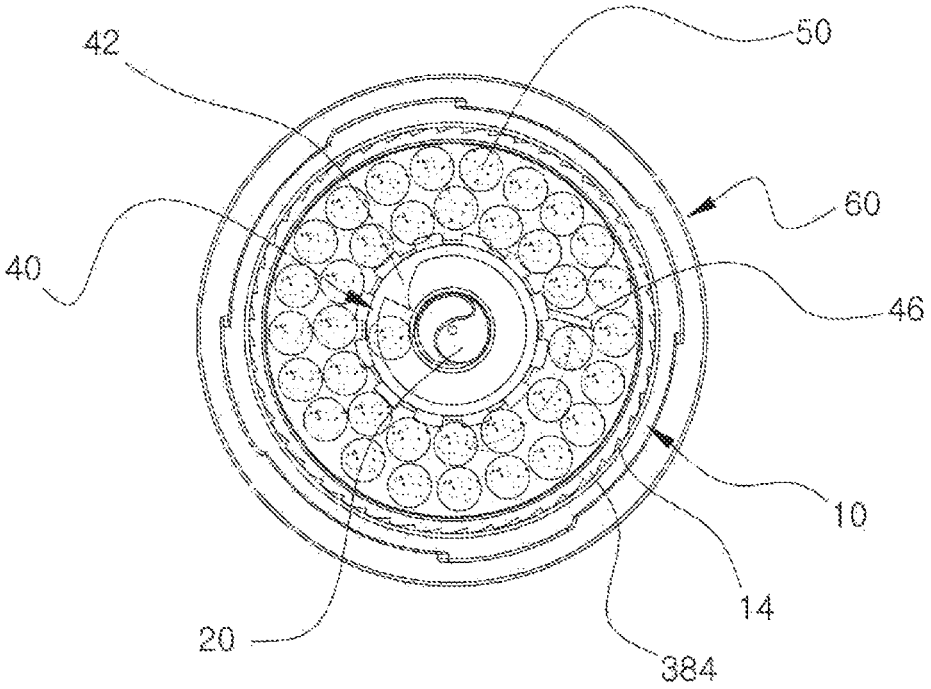
FIG. 4*a* is a plan view of the capsule container of FIG. 1, omitting the cap, illustrating the situation during rotation of the hollow cylinder of the container.
Figure 4B:
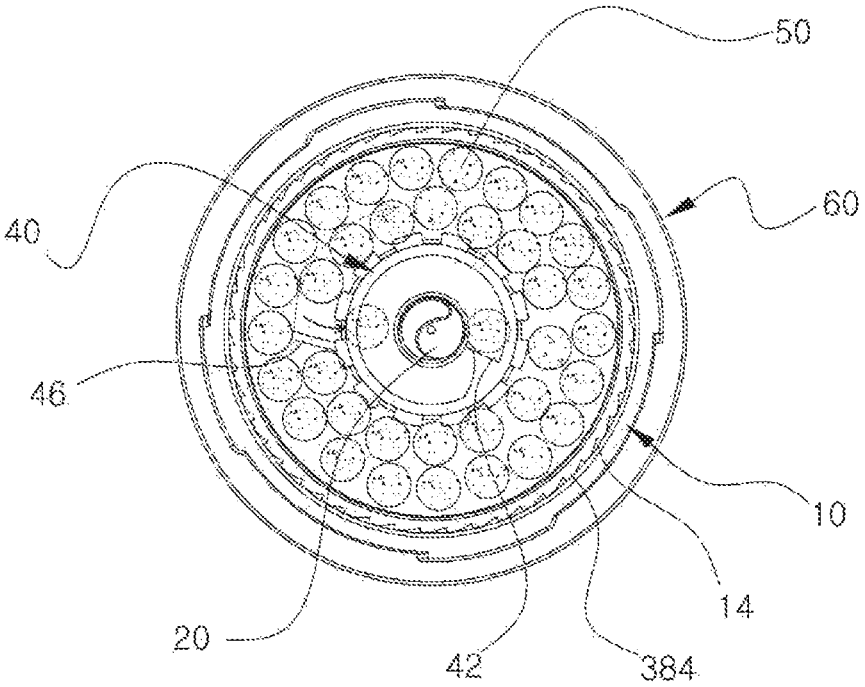
FIG. 4*b* is a view similar to FIG. 4*a* illustrating the situation when capsules are caused to flow into the inside of the hollow cylinder via the entry port as a result of rotation of the hollow cylinder.

An entry port 44 into which capsules 50 flow is formed on one side at the lower part of the cylinder 40, and an inflow guide 46 is formed protruding outwardly on one side of the entry port 44. Thus, as shown in FIGS. 4*a* and 4*b*, when the cylinder 40 is rotated, the inflow guide 46 is also rotated to cause horizontal pressure on the capsules 50 stored inside the container 10, thereby enabling ready inflow of capsules 50 into the entry port 44 of the cylinder 40.

An installation ring-shaped groove 48 is formed on the bottom inner circumference of the cylinder 40 and is rotatably coupled with the installation protruding ring 182 of the container 10.

Figure 5A:
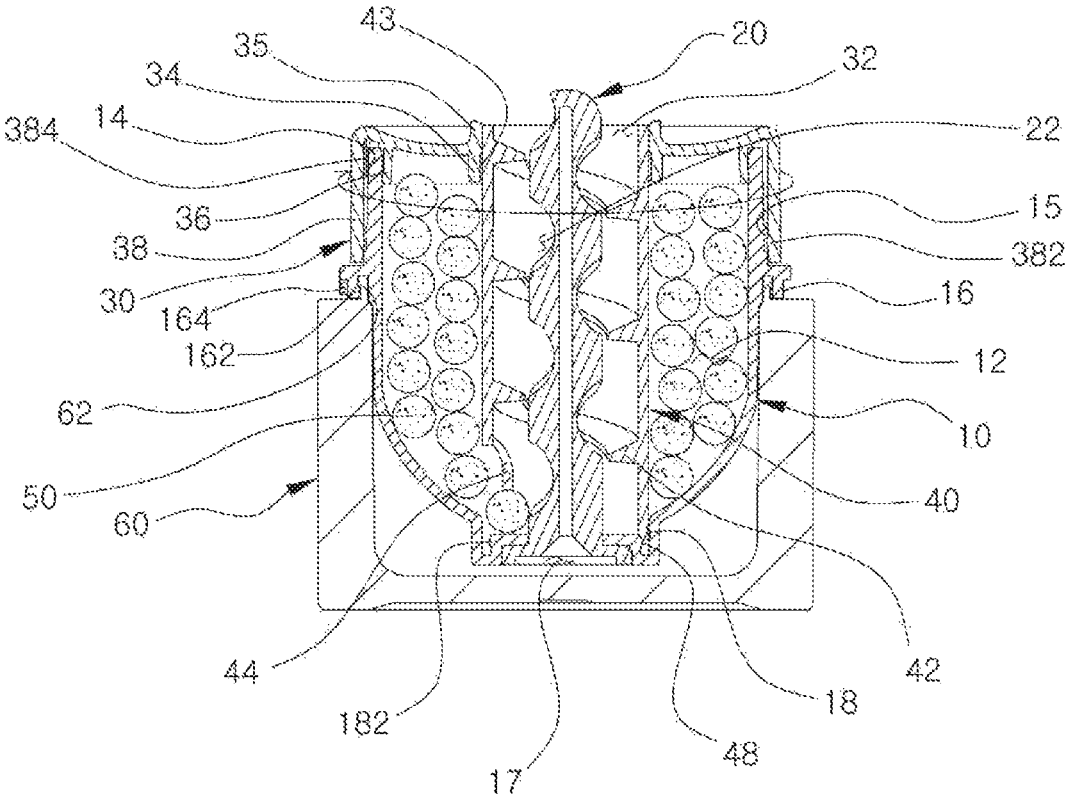
FIG. 5*a* is a sectional elevational view of the capsule container of FIG. 1, illustrating the situation when capsules are being caused to flow into the inside of the hollow cylinder via the entry port as a result of rotation of the hollow cylinder.
Figure 5B:
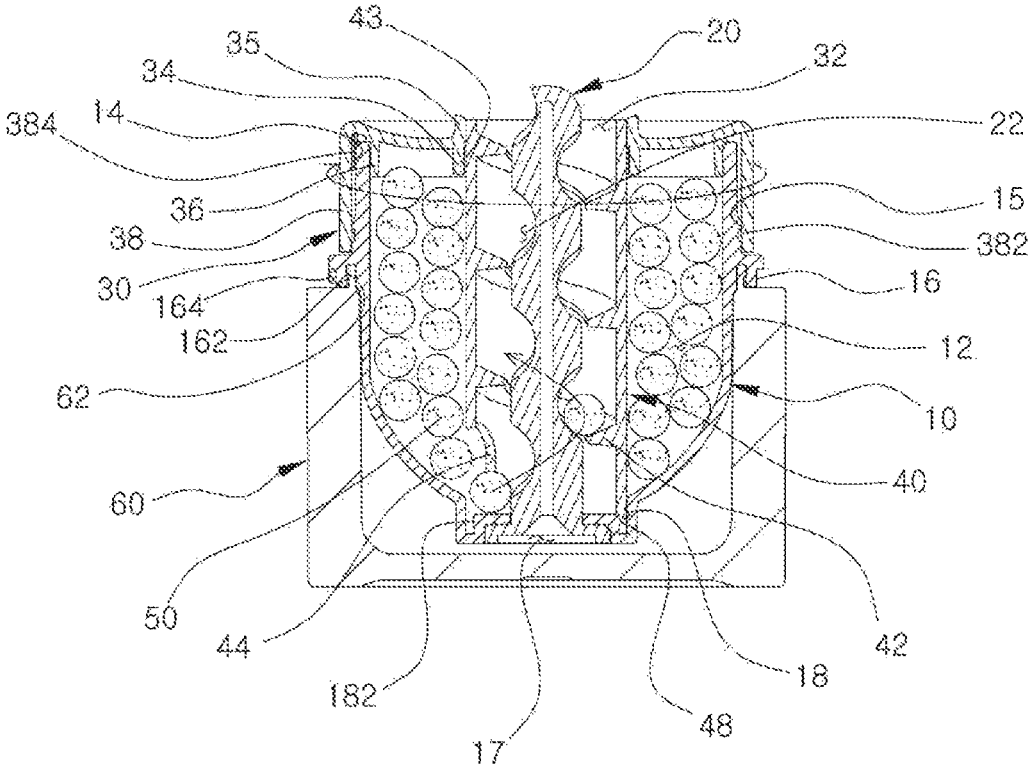
FIG. 5*b* is a view similar to FIG. 5*a* illustrating the situation when capsules are being caused to move upwards as a result of rotation of the hollow cylinder.
Figure 5C:
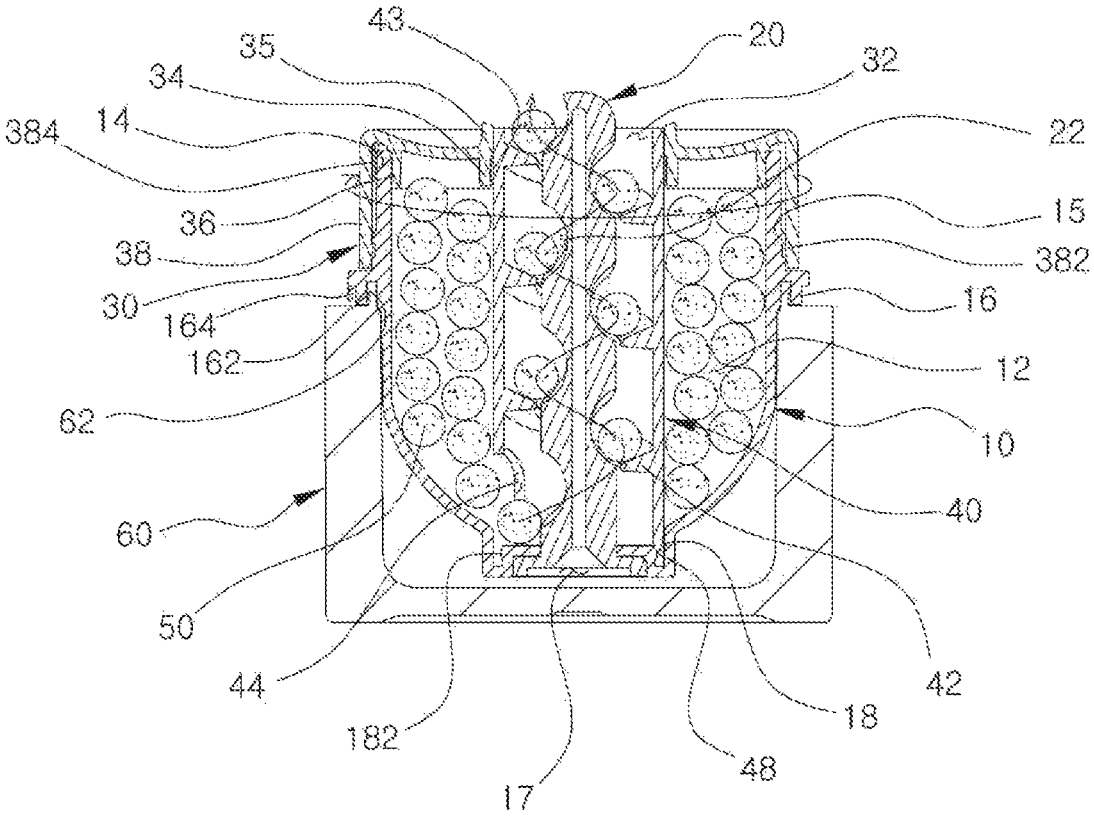
FIG. 5*c* is another view similar to FIG. 5*a* showing the situation when capsules are being discharged one by one from the discharge port as a result of rotation of the hollow cylinder.
Figure 6:
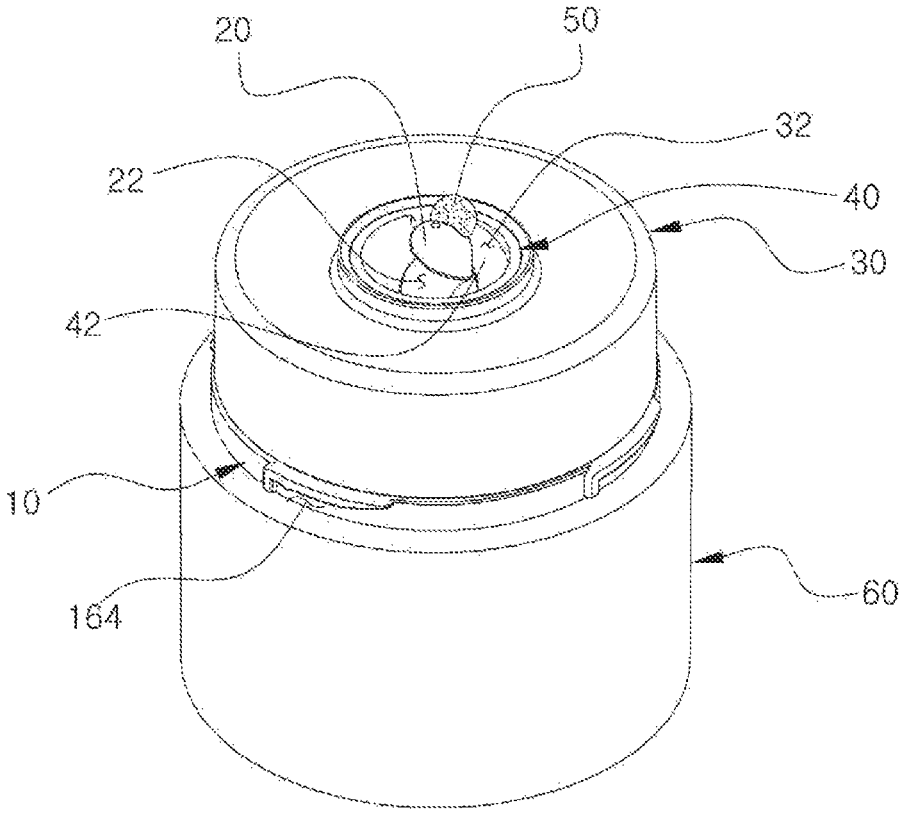
FIG. 6 is a perspective view of the capsule container of FIG. 1, illustrating the situation when capsules are being discharged from the discharge port of the container.

A thread 42 is formed on the inner circumference of the cylinder 40. This thread 42 of the cylinder 40 and the spiral groove 22 of the screw shaft 20 are formed in mutually opposing directions. When the cap 30 is rotated, although the screw shaft 20 is fixed in the container 10, the cylinder 40 rotates together with the cap 30, and as shown in FIG. 5*a*, pushes up the capsules 50 that have entered via the entry port 44. Because the thread 42 of the rotary cylinder 40 and the spiral groove 22 of the screw shaft 20 are formed in mutually opposing directions, as shown in FIG. 5*b* the capsules are smoothly carried upwards at the point where the spiral groove 22 of the screw shaft 20 and the thread 42 of the rotary cylinder 40 intersect, via the spiral groove 22 of the screw shaft 20 and while borne on the thread 42 of the rotary cylinder 40, and are discharged at the end of the spiral groove 22 of the screw shaft 20 as shown in FIG. 5*c*. As shown in FIGS. 5*b* and 5*c*, the intersecting thread 42 and groove 22 form cavities larger than the size of the capsules 50 to receive the capsules without crushing them.

Accordingly, the spiral groove 22 of the screw shaft 20 forms a path for the capsules 50, and the thread 42 of the cylinder 40 enacts a pushing role on the capsules 50.

A container lid 70 for opening and closure of the discharge port 32 of cap 30 is provided and mounted on the upper part of the cap 30. This container lid 70 comprises an inner container lid 71 and an outer container lid 72 to be joined onto the outside of the inner container lid 71. A first tight closure protruding ring 74 is formed extending downwards on the inside of the top surface of the inner lid 71, and a second tight closure protruding ring 75 is formed extending downwards on the outside of the first tight closure protruding ring 74 at a fixed interval.

A tightly sealing ring 76 for sealing the interior of the container 10 is combined between the first tight closure protruding ring 74 and the second tight closure protruding ring 75. When the container lid 70 is closed, the sealing ring 76 makes close contact with the top part of the upwardly extending protruding ring 35 of the rotary cap 30. The tightly sealing ring 76 is formed from an elastic material, and preferably comprises one or more materials selected from among natural rubbers, elastomers, silicone rubbers and acrylonitrile-butadiene rubbers, or is constructed from polypropylene or polyethylene.

An opening and closure protrusion 78 is formed in the internal circumference on the lower part of the container lid 70. This protrusion fits into an opening and closure groove 164 of the container 10.

In a method of assembling the capsule packaging container of FIGS. 1-6, a screw shaft 20 is first fixed and bonded in the center in the inside of container receptacle 10 as shown in FIGS. 2-3; the screw shaft is inserted from underneath the through-hole 17 of the container 10 and thereafter forcibly interlocked. The container receptacle 10 is then inserted into the top of the container main body 60 and fixed and bonded. Next, the rotary hollow cylinder 40 is fitted together with the installation groove 18 of the container receptacle 10, wherein, while the screw shaft 20 is disposed inside the cylinder 40, the installation protruding ring 182 of the container 10 is inserted in the installation ring-shaped groove 48 of the cylinder 40.

Capsules 50 are then charged into the interior of the container receptacle 10. Next, the rotary cap 30 is rotatably coupled to the upper part of the container 10, with the first interlocking protrusions 34 of the rotary cap 30 inserted into the second interlocking protrusions 43 of the rotary cylinder 40, and at the same time, the first ratchet gear 14 of the container 10 is made to interlock with the second ratchet gear 384 of the cap 30, and the first fastening protruding ring 15 of the container 10 is coupled in an undercut manner with the second fastening protruding ring 382 of the rotary cap 30.

Finally, the lid 70 is fitted on top of the container 10, with the tightly sealing ring 76 inserted between the second tight-closure protruding ring 75 and the first tight closure protruding ring 74 of the lid 70, and the opening and closing protrusion 78 of the lid 70 is horizontally inserted into the opening and closure groove 164 of the container 10, thereby completing the assembly of the container.

In use of the packaging container of FIGS. 1-6, the lid 70 is first detached from the container 10. The user, holding the container main body 60 with one hand, then rotates the cap 30 with the other hand.

When the cap is thus rotated, the cylinder 40 is rotated together with the cap, and as shown in FIG. 4*a* the inflow guide 46 of the cylinder 40 exerts horizontal pressure on the capsules 50 stored inside the container receptacle 10, causing capsules to enter one by one inside the cylinder 40 via the entry port of the cylinder as shown in FIG. 4*b*.

Thereafter, when the cap 30 is further rotated as shown in FIGS. 5*a* and 5*b*, while the screw shaft 20 remains fixed in the container 10, the cylinder 40 rotates with the cap 30 and the capsules 50 that have entered via the entry port 44 are caused to slide upwards. Because the thread 42 of the cylinder 40 and the spiral groove 22 of the screw shaft 20 are formed in mutually opposing directions, as shown in FIG. 5*b* the capsules 50 are smoothly carried upwards at the point where the spiral groove 22 and the thread 42 intersect, via the spiral groove and while borne on the thread 42, and are discharged at the end of the spiral groove as shown in FIG. 5*c*. A capsule thus discharged via the discharge port 32 of the cap 30 is picked up by the user and applied to the skin.

The screw shaft 20 is formed higher than the rotary cylinder 40, so that capsules 50 discharged from the container 10 can be completely exposed out of the cylinder 40 by the screw shaft 20.

To recapitulate, in the capsule container of FIGS. 1-6 the receptacle portion 10 and the screw shaft 20 are fixed to each other while cap 30 and the hollow cylinder 40 coupled to the cap rotate together, relative to the receptacle portion and screw shaft, when the cap is rotated manually on the container. The vertical geometric axes of the receptacle portion, the screw shaft and the hollow cylinder are coincident with each other and also with the axis of rotation of the cap and cylinder relative to the receptacle portion and screw shaft as well as with the axes of the helices of the screw shaft spiral groove 22 and the hollow cylinder internal thread 42.

Thus, manual rotation of the cap (and of the cylinder with it) moves the inflow guide 46 on the cylinder through the multiple capsules 50 held in the stationary receptacle outside the cylinder, so that the guide pushes capsules individually from the receptacle through the entry port 44 into the cylinder interior where each introduced capsule is received in turn in a gap or space defined between the cylinder thread 42 (rotary) and the screw shaft spiral groove 22 (stationary). Cooperation between the rotating helical thread 42 and the stationary helical groove 22 (opposite in rotational sense to the thread) causes each capsule to move upwardly, in a helical path around the common axis of the shaft and cylinder, until the capsule emerges through the discharge port 32 in the cap 30, successive capsules thereby being discharged individually (one by one) as desired. Such upward movement of the capsules requires that the cap be turned (rotated) by the user in a particular direction dependent on the rotational senses of the cylinder thread and the spiral groove. The ratchet gears 14 and 384 assure that the manual turning of the cap is permitted only in that particular direction which causes the capsules to move upwardly.

Another embodiment of the capsule container of the invention is illustrated in FIGS. 8-14; in FIGS. 1-7 and 8-14, like reference numerals indicate like features and elements.

The embodiment shown in FIGS. 8-14 includes a capsule container receptacle or vessel for holding a plurality of capsules wherein a spiral rod or screw shaft having a spiral groove on its outer circumference is affixed to and formed on the center inside the container receptacle and a rotary cap is rotatably coupled to the top of the container receptacle, a rotary hollow cylinder is coupled to the lower center of the rotary cap and disposed on the outside of the screw shaft in surrounding concentric relation thereto, a discharge cover provided with a discharge outlet is formed on the top center of the rotary cap, a spiral thread is formed on the inner periphery of the rotary cylinder, and an inlet part or entry port is formed on one lower side of the cylinder. Thus, when the rotary cap is rotated, after capsules held in the receptacle enter the rotating cylinder through the entry port, the capsules are moved to the top of the container by the spiral groove of the screw shaft and the thread of the cylinder and easily discharged one by one to the upper surface of the rotary cap through the discharge port of the discharge cover.

Further, an anti-friction part is formed on the bottom of the receptacle, an inflow guide is formed so as to project to one side of the entry port of the rotary cylinder, and the spiral groove and the thread of the cylinder are formed in mutually opposite directions, so that when the cap is rotated, after capsules are easily introduced through the entry port into the rotary cylinder as it naturally moves, each capsule follows the spiral thread of the rotary cylinder at the point of intersection of the thread and the spiral groove of the screw shaft and is smoothly moved to the top of the container. A slope is formed on the lower part of the discharge cover so that the capsule may be naturally discharged. The inflow guide formed on one side of the entry port of the rotary cylinder is constituted of an upper cover formed so as to protrude on the top of the entry port, and a side cover formed so as to protrude on one side of the entry port.

In addition, the container has a lid. A first sealing ring is formed on the inside of the container vessel or receptacle so as to come into close contact with the inner periphery of the receptacle, and a second sealing ring of an elastic material is formed on the inside of the vessel lid such that when the lid is closed, the second sealing ring comes in close contact with the top surface of the rotary cap; therefore, during transport or storage of the container, the sealing force of the inside of the container is improved.

Figure 8:
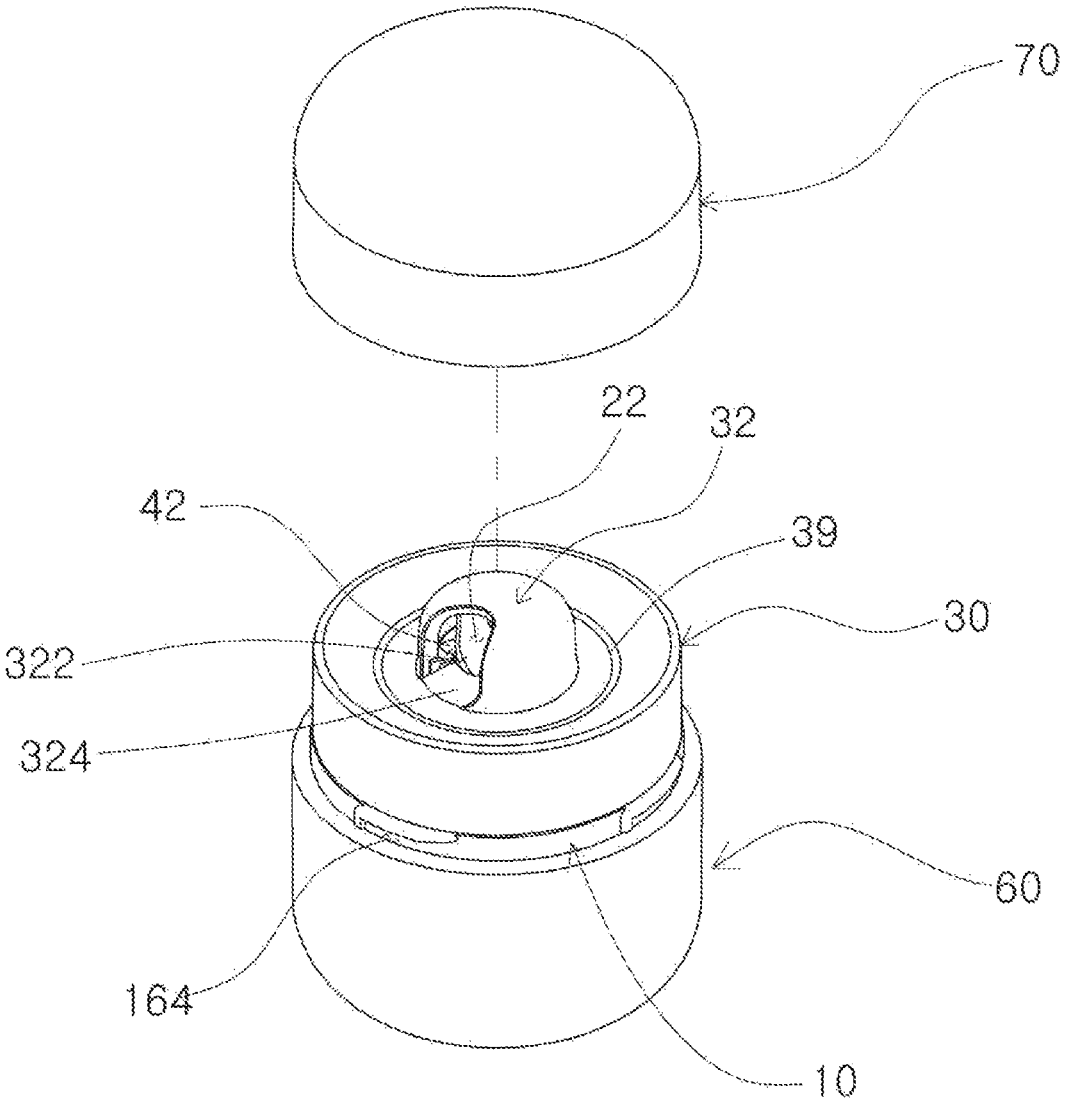
FIG. 8 is a perspective view of another embodiment of the capsule container of the invention.
Figure 9:
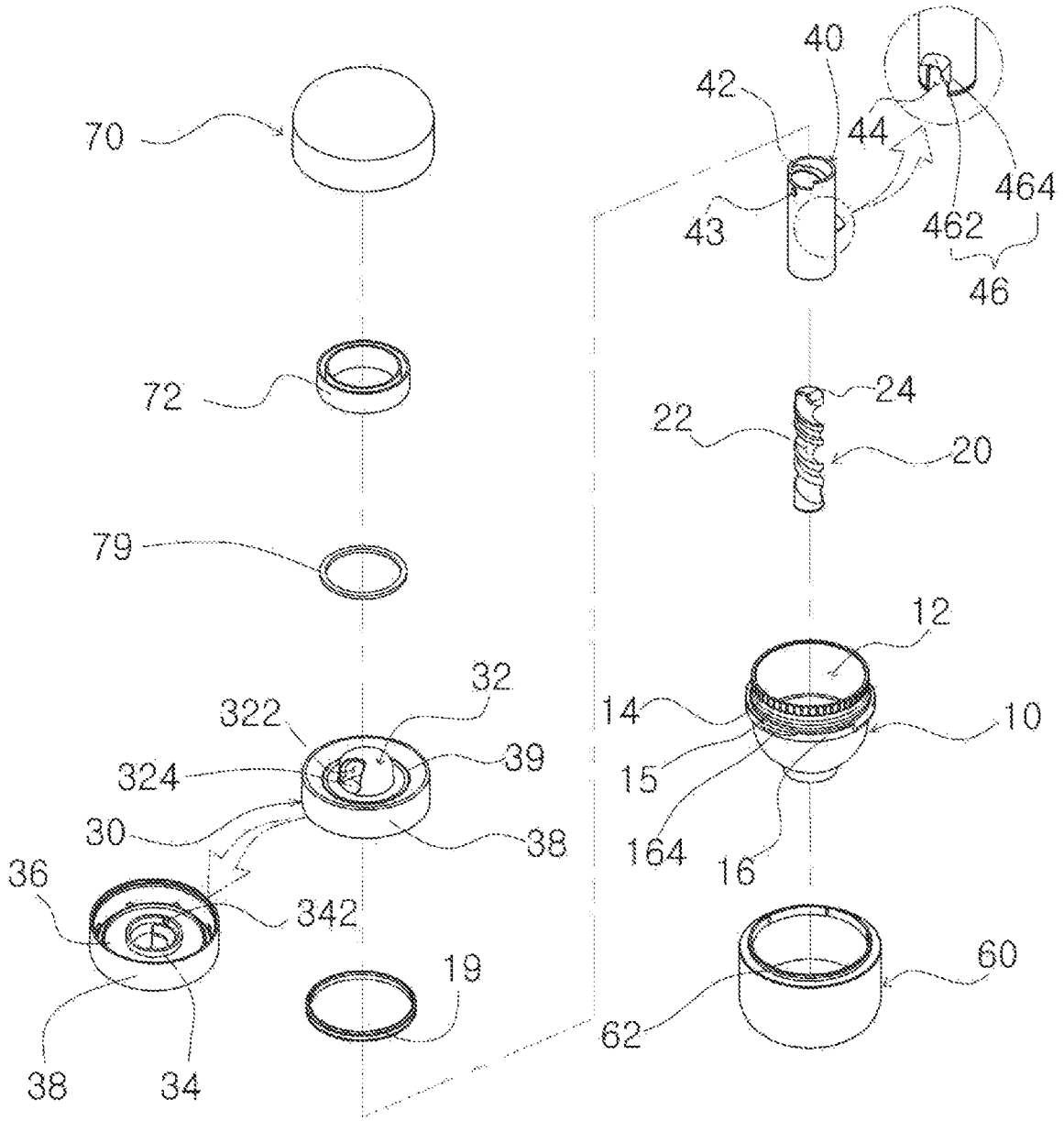
FIG. 9 is an exploded perspective view of the capsule container of FIG. 8.
Figure 10:
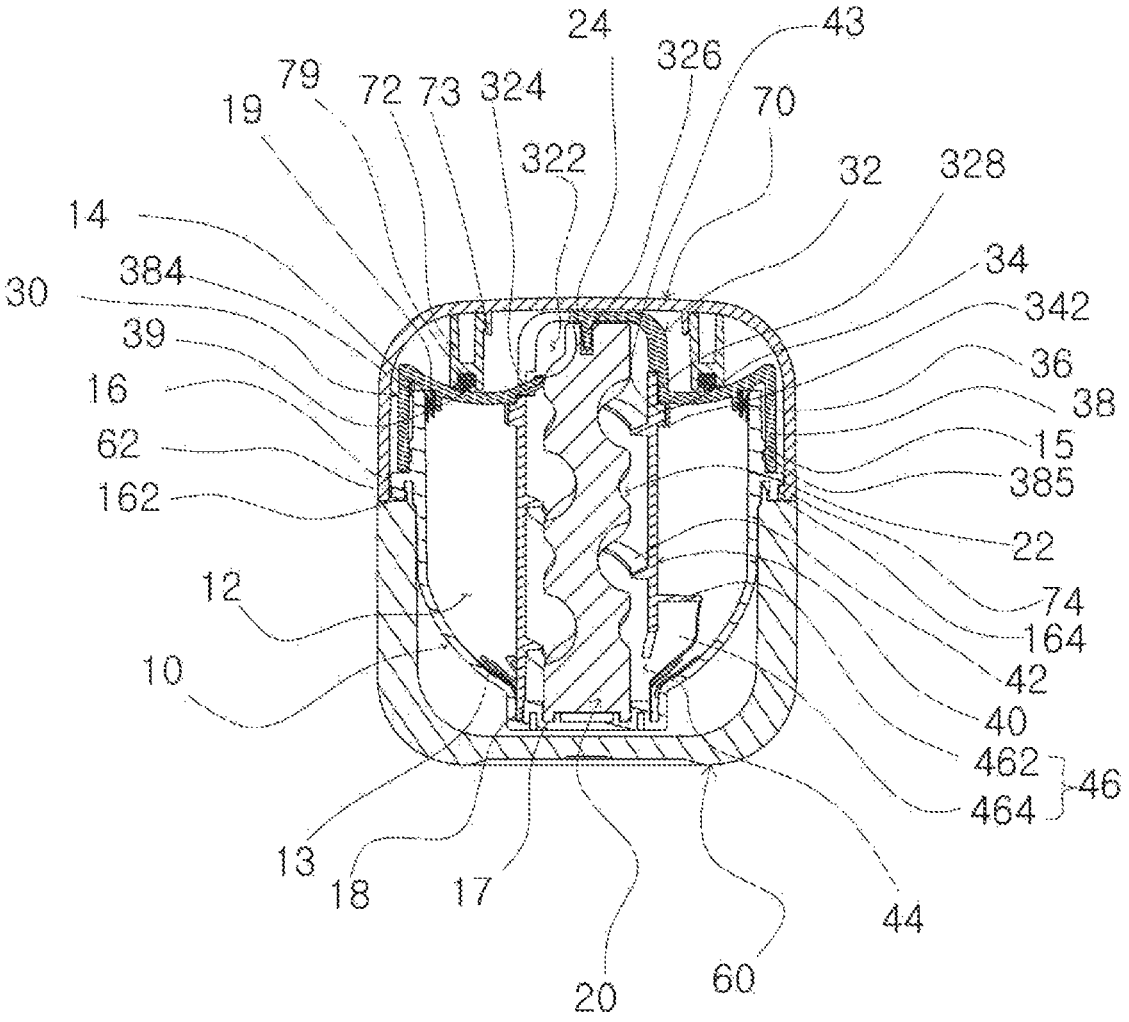
FIG. 10 is a sectional elevational view of the capsule container of FIG. 8.

Referring particularly to FIGS. 8-10, which are respectively a perspective view, an exploded perspective view and a sectional elevational view of this embodiment, the container shown includes a vessel or receptacle 10 inside which a plurality of capsules 50 are stored; a spiral rod or screw shaft 20 fixedly coupled to the center of the receptacle 10 inside the receptacle; a rotary cap 30, rotatably coupled to the receptacle 10; and a rotary cylinder 40, disposed on the outside of (concentrically surrounding) the screw shaft 20 and provided with an entry port 44. A spiral groove 22 is formed on the outer periphery of the screw shaft 20, a spiral thread 42 is formed on the inner surface of the cylinder 40, and a discharge cover 32 provided with a discharge port 322 is formed in the center of the cap 30.

This interior of the container vessel or receptacle 10 is a capsule-receiving space 12, in which a plurality of capsules 50 are accommodated. These capsules, in form and content, may be as described above with reference to FIGS. 1-6.

A first ratchet gear 14 of saw-toothed shape is formed on the upper, outer periphery of the receptacle 10 so that the cap 30 can be rotated only in one direction relative to the receptacle. A first fastening extension 15 is formed on the outer periphery of the receptacle 10 to which cap 30 is undercut-coupled.

A lower extending extension 16 is extended to the lower side of the first fastening extension 15, a first installing extension 162 is formed so as to extend inward to the inner periphery of the lower extending extension 16, and an opening groove 164 is formed on one side of the outer periphery.

The inner bottom surface of the receptacle 10 is of a concave shape. A screw shaft coupling groove 17, to which the screw shaft 20 is fixed and coupled, is formed on the center of the receptacle bottom surface, and a mounting groove 18, to which the rotary cylinder 40 is rotatably coupled, is formed outside of and in concentric relation to the coupling groove 17.

An anti-friction part 13 may be formed on the bottom of the receptacle 10. This anti-friction part is formed in the shape of a radial-shaped groove on the bottom of receptacle 10. For the anti-friction part 13 to reduce the area where the bottom inner surface of the receptacle 10 and capsules 50 are in contact so that capsules flow easily, when the capsules are caused to move horizontally while the inflow guide 46 of cylinder 40 is rotated, friction is generated by surface contact of capsules with the bottom surface of the receptacle, preventing crushing by pressing on the inflow guide 46.

A first sealing ring 19 for sealing the inside of the container receptacle 10 is formed on the inside of, and in close contact with the inner periphery of, receptacle 10. When the container is transported or stored, the moisture content of the capsules 50 accommodated within the receptacle is maintained by the first sealing ring 19, and drying of the capsules is prevented.

A container body 60 surrounding the receptacle 10 is coupled on the outside of the receptacle. A second installing extension 62 is formed on the upper outer periphery of the body 60 and undercut coupled with the first installing extension 162 of the receptacle 10.

The screw shaft 20, as stated, is fixed and coupled to the center of the inside of container receptacle 10, the lower end of the screw shaft being force fit-coupled or screw-coupled to the coupling groove 17 of the receptacle. Alternatively, the screw shaft 20 may be integrally formed on the center of the bottom surface of receptacle 10. The screw shaft, having spiral groove 22 formed on its outer periphery, extends upward; the top of the screw shaft is positioned on the inner side of the discharge cover 32 of the rotary cap 30.

A fixing groove 24 is formed on the upper end of the screw shaft 20, and a fixing protrusion 326 of the rotary cap 30 is inserted therein. The rotary cap 30, rotatably coupled to the top of receptacle 10, bears the discharge cover 32 at its center; cover 32 is provided with discharge port 322 formed on one side thereof. The discharge cover may either be formed integrally with the cap 30 or it may be separately formed.

A slope 324 is formed on the lower side of the discharge port 322 of the discharge cover so that capsules 50 are naturally discharged. A capsule, moved to the top by means of the spiral groove 22 of the screw shaft 20 and the spiral thread 42 of the cylinder 40, follows slope 324 from the upper side end of groove 22, naturally tumbles down and is discharged to the top surface of the cap 30.

The fixing protrusion 326, formed on the inner side of the discharge cover 32 and inserted into the fixing groove 24 of the screw shaft 20, keeps the shaft centered so that the shaft does not tilt in any direction.

An insertion groove 328, into which the rotary cylinder 40 is inserted, is formed on the lower inner periphery of the discharge cover 32. The top surface of the rotary cap 30 is of a concave curved shape; a closed protrusion 39, in close contact with a second sealing ring 79 of the container lid 70, may be formed on one side of the cap top surface.

A first lower extending extension 34 is formed on the bottom of the rotary cap 30 so as to extend downward, a second lower extending extension 36 is spaced at regular intervals outwardly from the first lower extending extension 34, and a third lower extending extension 38 is formed so as to be spaced at regular intervals outwardly from the second lower extending extension 36. A fitting groove 342 is formed on the inner periphery of the first lower extending extension 34 by coupling with the rotary cylinder 40. A first sealing ring 19 is inserted between the second lower extending extension 36 and container receptacle 10, and seals the inside of receptacle 10.

A second fastening extension 385 is formed so as to protrude to the inner periphery of the third lower extending extension 38 and undercut couples with the first fastening extension 15 of the receptacle 10.

A second ratchet gear 384 engaging with the first ratchet gear 14 of the receptacle 10 is formed on the top outer periphery of the third lower extending extension 38. Therefore, the rotary cap 30 can rotate in only one direction relative to the container receptacle 10, and reverse rotation is prevented. Also, when the cap 30 is rotated, the second ratchet gear 384 of cap 30 follows the first ratchet gear of receptacle 10 and a sound is made when the second gear goes beyond the first gear, so that the user may know that a capsule is rising.

The rotary cylinder 40 is installed on the outside of (concentrically surrounding) the screw shaft 20; at the same time, the cylinder is coupled to the central lower side of the rotary cap 30, the top of cylinder 40 being inserted into the insertion groove 328 of the cap and the bottom of the cylinder being rotatably coupled with the mounting groove 18 of receptacle 10.

Fitting protrusion 43 is formed on the outer periphery of the top of the rotary cylinder 40 and coupled with fitting groove 342 of the cap 30. When the fitting protrusion 43 fits into fitting groove 342 and the cap rotates, the cylinder 40 does not run in a disengaged manner; this serves to ensure that rotation of the cylinder occurs together with rotation of the cap 30.

The inlet or entry port 44 is formed on the lower side of the cylinder 40 so that capsules 50 are introduced one by one into the cylinder, and the inflow guide 46 is formed so as to protrude outwardly at one side of port 44. This inflow guide includes a top cover 462 protruding at the top of entry port 44 and a side cover 464 protruding at one side of entry port 44.

Figure 13A:
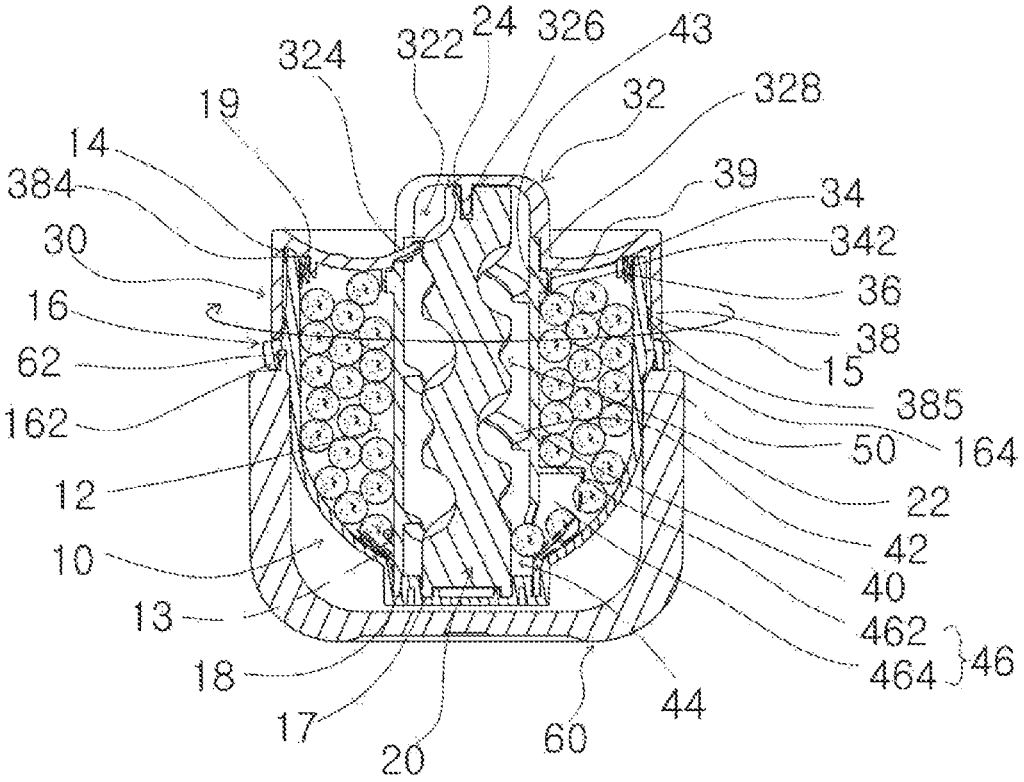
FIG. 13*a* is a sectional elevational view of the capsule container of FIG. 8, illustrating the situation when the hollow cylinder rotates with the rotary cap and capsules flow into the cylinder through the entry port.
Figure 13B:
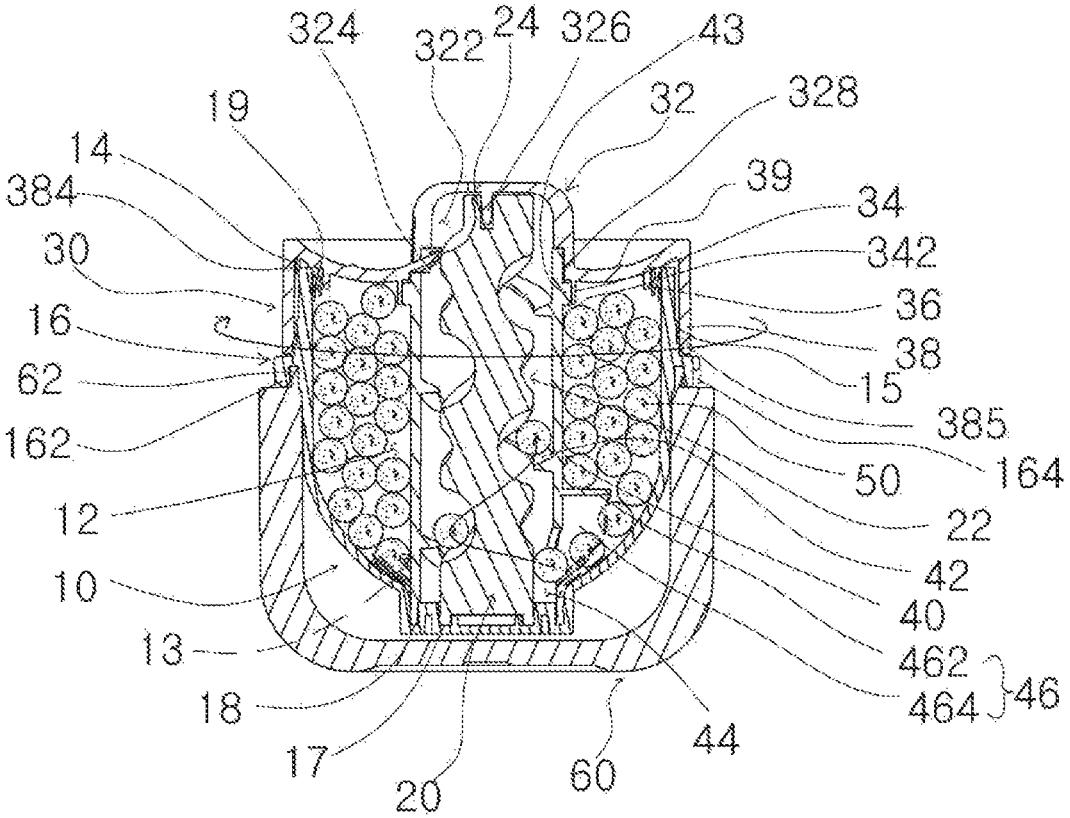
FIG. 13*b* is a view similar to FIG. 13*a* illustrating the situation when the hollow cylinder rotates with the rotary cap and capsules move to the top of the container.
Figure 13C:
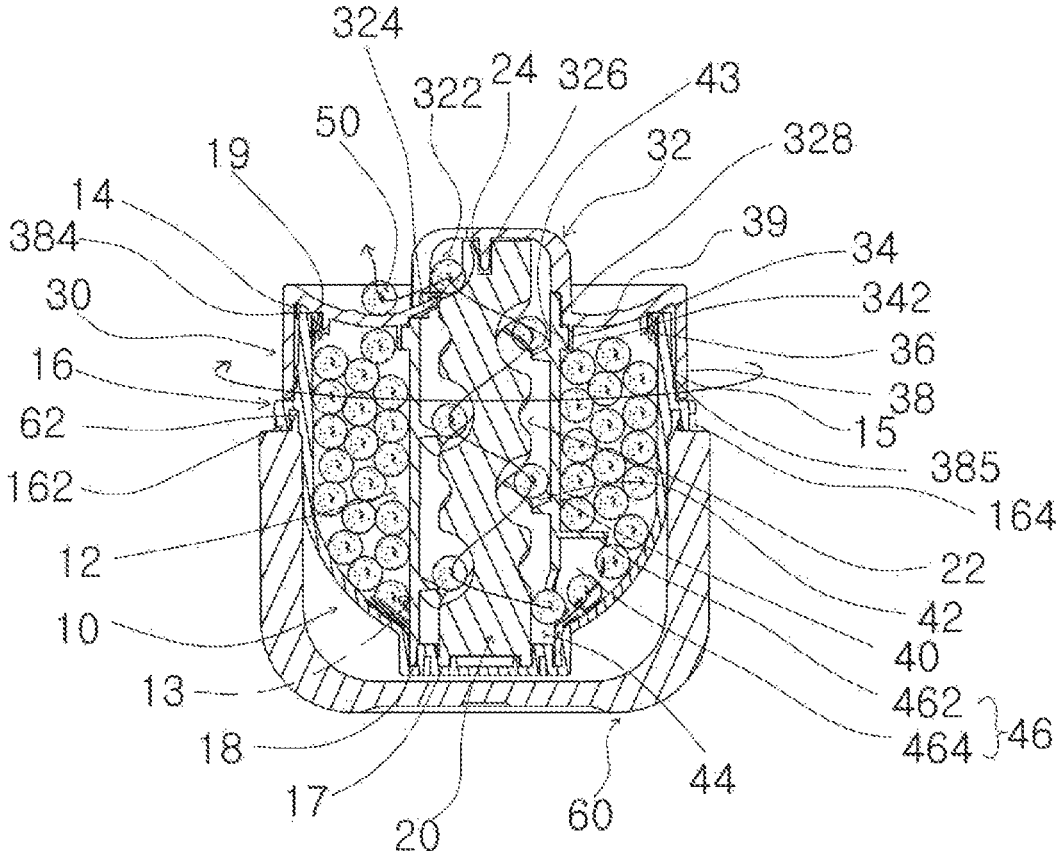
FIG. 13*c* is another view similar to FIG. 13*a* showing the situation when the hollow cylinder rotates with the rotary cap and capsules are discharged individually through the discharge port of the container.

FIGS. 13*a*, 13*b* and 13*c* are sectional elevational views, similar to each other, illustrating the container of FIG. 8 while the cylinder 40 and cap 30 are rotating together relative to the receptacle 10 and screw shaft 20. FIG. 13*a* shows the situation in which capsules 50 flow into the cylinder from the receptacle through entry port 44; FIG. 13*b* shows the situation in which capsules are moving upwardly to the top of the receptacle; and FIG. 13*c* shows the situation in which capsules are discharged individually (one by one) through the discharge port 322 onto the concave top surface of the cap.

The embodiment of FIGS. 8-14 addresses the problem that, as the multiple capsules 50 accommodated within the receptacle 10 are pressed by gravity, two or more of the capsules may enter the cylinder 40 through entry port 44 together. As FIGS. 13*a*-13*c* show, with the inflow guide top cover 462 formed so as to protrude outwardly at the top of the entry port 44, capsules 50 positioned at the front of the entry port are not pressed by other capsules, and enter the entry port one at a time.

Figure 12A:
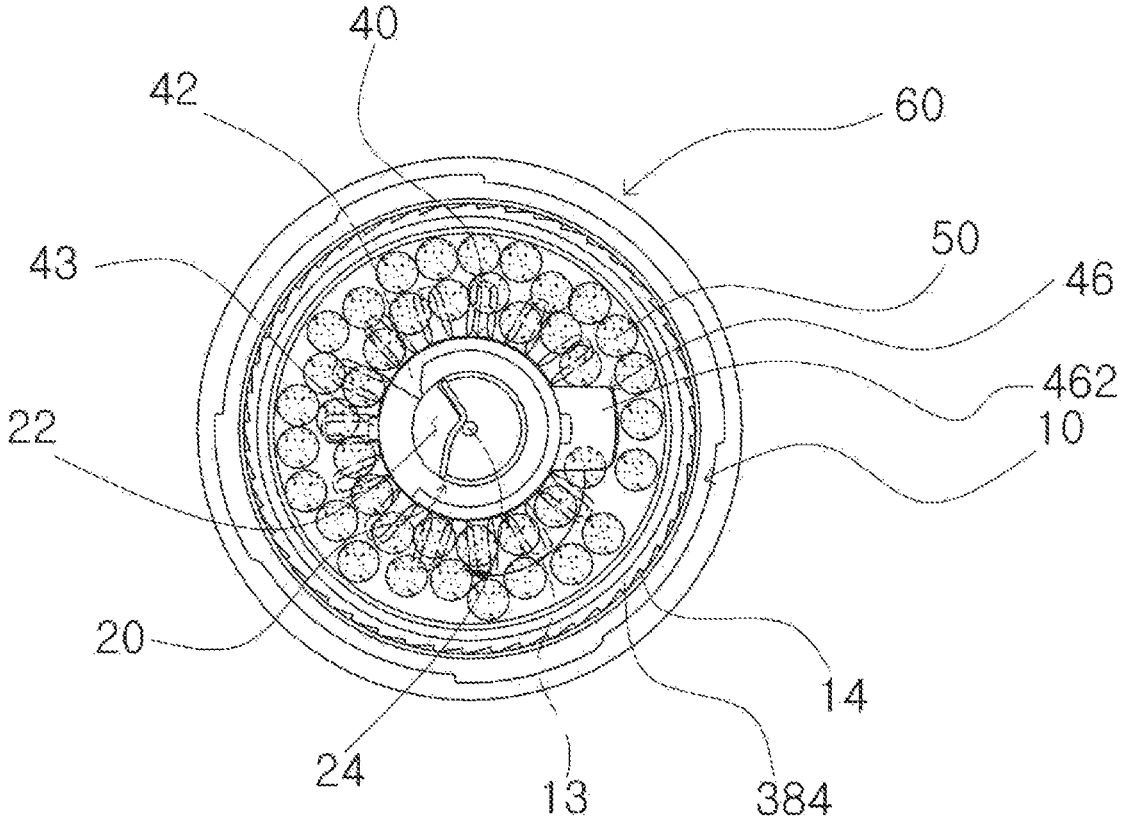
FIG. 12*a* is a plan view of the capsule container of FIG. 8, omitting the cap, illustrating the situation during rotation of the hollow cylinder.
Figure 12B:
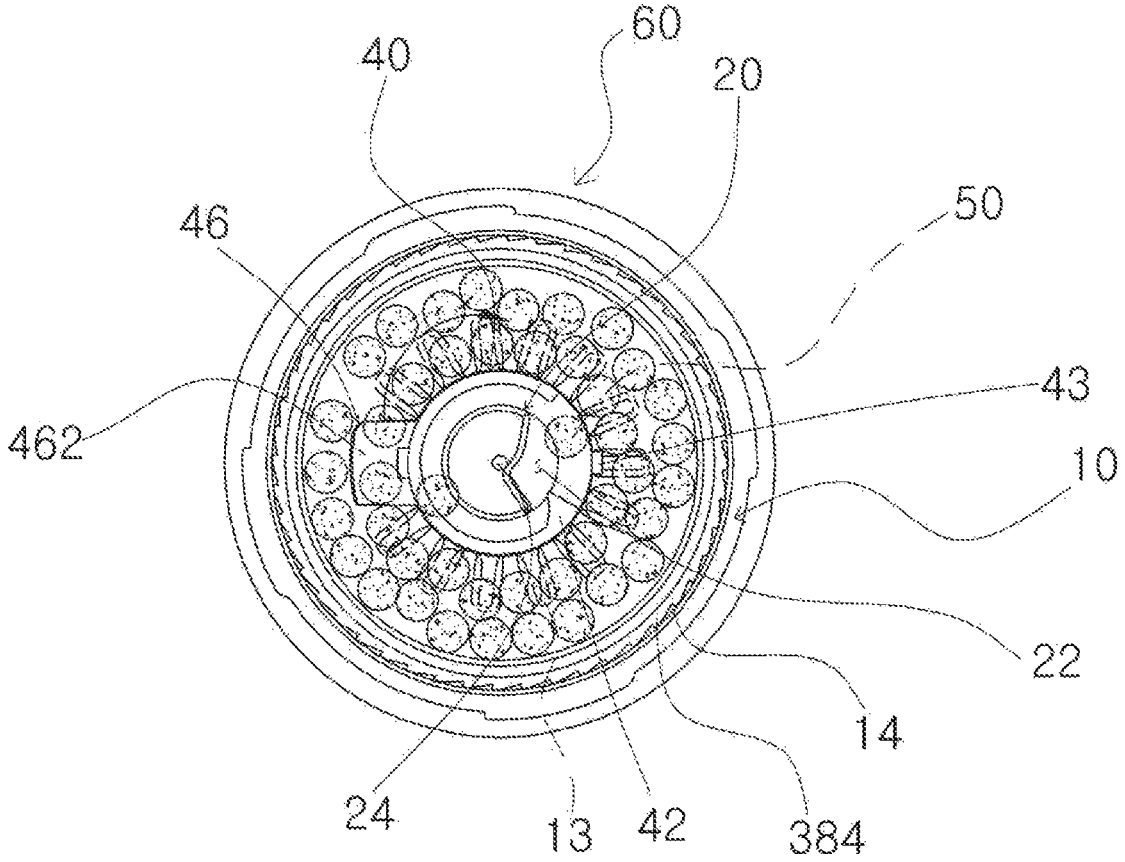
FIG. 12*b* is a view similar to FIG. 12*a*, illustrating the situation when capsules are caused to flow into the inside of the hollow cylinder through the entry port as a result of rotation of the cylinder.

FIGS. 12*a* and 12*b* are cross-sectional views (sectional plan views), similar to each other, illustrating the container of FIG. 8 while the cylinder 40 is rotating relative to the receptacle 10 and screw shaft 20. In particular, FIG. 12*b* shows the situation in which capsules 50 flow individually (one by one) into the cylinder through the entry port 44. As will be apparent from these Figures, as the cylinder 40 rotates, the inflow guide side cover 464 rotates together with it, horizontally pushing capsules 50 accommodated within the receptacle 10. Therefore, a capsule 50 is easily pushed and enters the entry port 44 of the rotary cylinder.

As explained, the spiral thread 42 on the inner periphery (inner surface) of the cylinder 40 and the spiral groove 22 of screw shaft 20 are formed in mutually opposite directions. Thus, when the cap 30 is rotated, while the screw shaft is fixed to receptacle 10, as shown in FIG. 13*a*, the cylinder 40 rotates with the cap 30 and a capsule 50 introduced through entry port 44 is pushed up, so that as shown in FIG. 13*b*, the capsule is placed on the thread 42 of the cylinder at the point of intersection of the screw shaft spiral groove 22 and the cylinder thread 42, and follows the screw shaft groove 22 so that it moves gently upwards, and as shown in FIG. 13*c* is discharged form the end of screw shaft groove 22 to the outside through the discharge port 322. The spiral groove 22 of the screw shaft 20 therefore becomes a path over which the capsule 50 passes, and the spiral thread 42 of the rotary cylinder 40 performs a role of pushing up the capsule 50.

A lid 70, for opening and closing the discharge port 322 of the cap 30, is coupled to the top of the cap 30. A ring-shaped sealing member 72 is coupled to the inside of the lid 70; this sealing member is undercut-coupled or screw-coupled to the outer periphery of a coupling port 73 formed so as to protrude to the lower side of the lid 70. A second sealing ring 79 of elastic material is formed on the lower side of the sealing member 72; when the lid 70 is closed, as shown in FIG. 10, the second sealing ring 79 is in close elastic contact with sealing extension 39 of cap 30. The second sealing ring 79 is formed of elastic material; preferably it consists of one or more materials selected from among natural rubber, elastomer, silicone rubber and acrylonitrile-butadiene rubber (NBR), or of polypropylene (PP) or polyethylene (PE) material.

An opening and closing protrusion 74 is formed on the lower inner periphery of the lid 70 and coupled with opening and closing groove 164 of the receptacle 10.

To assemble the container of FIGS. 8-14, as shown in FIGS. 9 and 10, the screw shaft 20 is first fixed and coupled to the center of the inside of receptacle 10, and the lower end of the screw shaft 20 is coupled to the coupling groove 17 of receptacle 10. Next, the receptacle 10 is fixed and coupled to the container body 60 while being inserted into the container body through the top thereof. After that, the lower end of cylinder 40 is rotatably coupled to the mounting groove 18 of the receptacle 10, so that screw shaft 20 is disposed inside (concentrically surrounded by) the cylinder.

The inside of the receptacle 10 is then filled with capsules 50, and the first sealing ring 19 is fitted to the inner periphery of the top of receptacle 10. Following this, the cap 30 is rotatably coupled to the top of receptacle 10, the fitting protrusion 43 of cylinder 40 is fitted in the fitting groove 342 of the cap, and the first fastening extension 15 of the receptacle 10 and the second fastening extension 385 of the cap 30 are undercut-coupled while the first ratchet gear 14 of the receptacle 10 and the second ratchet gear 384 of cap 30 are matched.

At the same time, the outer periphery of second lower extending extension 36 of the cap 30 is made to be in close contact with the first sealing ring 19, and fixing protrusion 326 of cap 30 is inserted into fixing groove 24 of screw shaft 20. Next, sealing member 72 is coupled to coupling port 73 of lid 70, and second sealing ring 79 is fitted into the lower side of the sealing member 72. Finally, lid 70 is coupled to the top of receptacle 10, and opening/closing protrusion 74 of lid 70 is horizontally inserted into opening/closing groove 164 of receptacle 10, to complete the assembly of the container of FIGS. 8-14.

Figure 11:
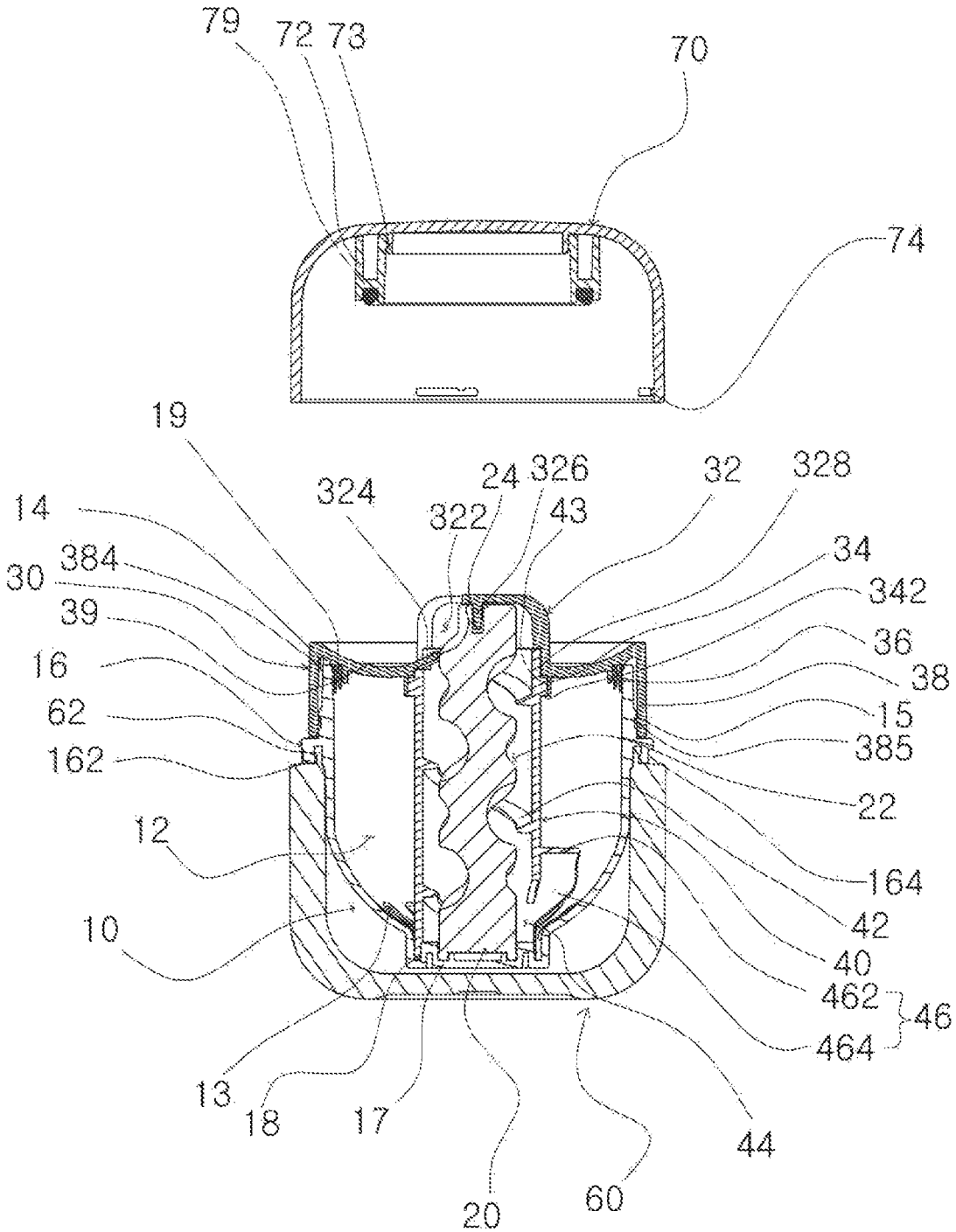
FIG. 11 is another sectional elevational view of the capsule container of FIG. 8, showing the lid separated from the cap.

In use of the container of FIGS. 8-14, as shown in the elevational sectional view of FIG. 11, the lid 70 is first separated from the receptacle 10. The user then holds the container body 60 with one hand while holding the rotary cap 30 with the other hand and rotating the cap manually (relative to the body 60 and the receptacle 10) in the one direction permitted by the ratchet gears 14, 384.

As the cap 30 is rotated, the cylinder 40 rotates therewith, and as shown in FIG. 12*a* the inflow guide side cover 464 on cylinder 40 horizontally pushes a capsule 50 accommodated within the receptacle 10, so that the capsule enters the inside of cylinder 40 through the entry port 44 of the cylinder. The inflow guide top cover 462, protruding outwardly at the top of entry port 44, prevents a capsule 50 positioned in front of the entry port from being pressed by other capsules 50 within the receptacle, so that the capsules enter the entry port one at a time.

Further, anti-friction part 13, formed on the bottom of the receptacle, serves to reduce the area where the bottom surface of the receptacle and a capsule 50 are in contact. Consequently, the capsule 50 flows easily within the receptacle.

Thereafter, as shown in FIGS. 13*a* and 13*b*, while the cap 30 is continuously rotated, with screw shaft 20 fixed to receptacle 10 and cylinder 40 rotating together with cap 30 relative to the shaft and receptacle, each capsule 50 introduced to the cylinder 40 through entry port 44 is pushed up to the top of the container.

Since the thread 42 of cylinder 40 and the spiral groove 22 of screw shaft 20 are formed in mutually opposite directions, as shown in FIG. 13*b* each capsule 50 is placed on the cylinder thread 42 at the point of intersection of the screw shaft spiral groove 22 and thread 22, and follows the spiral groove 22 so that it moves gently upwards, and as shown in FIG. 13*c* it is discharged to the top surface of cap 30 through discharge port 322.

Figure 14:
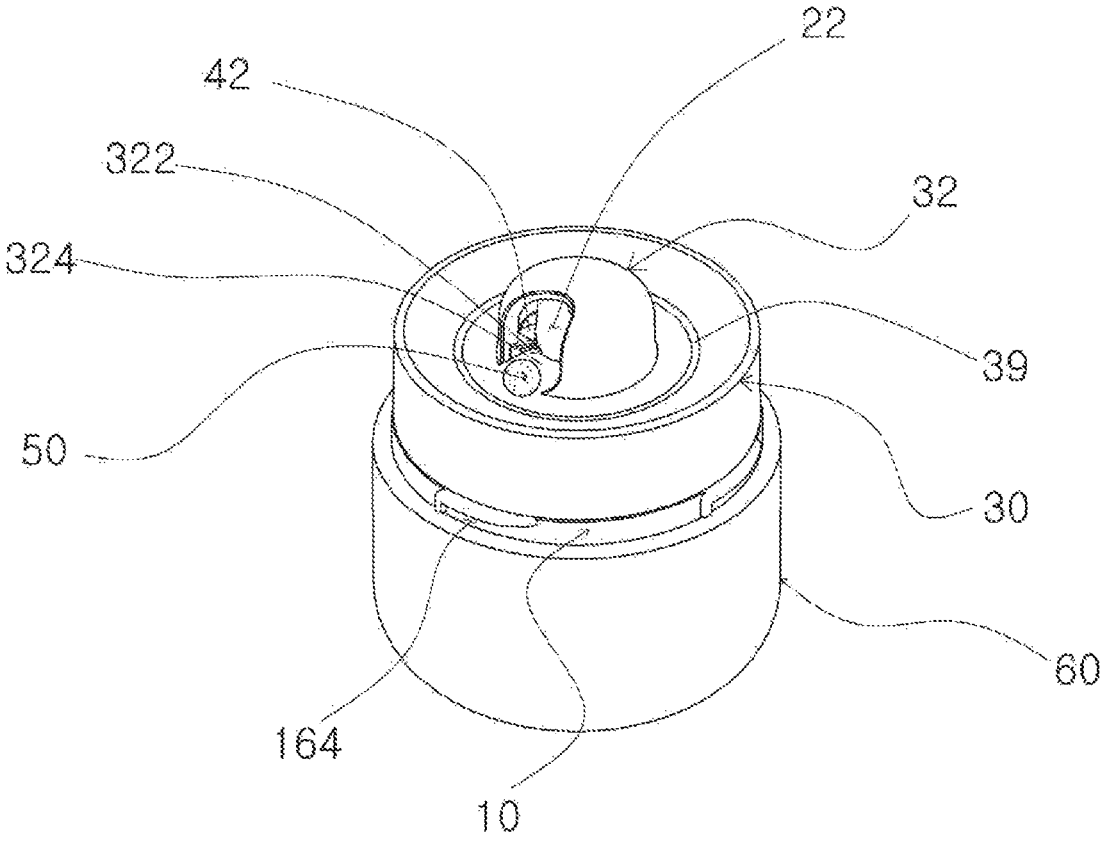
FIG. 14 is a perspective view of the capsule container of FIG. 8, showing the situation in which a capsule is discharged individually to the top surface of the rotary cap of the container.

FIG. 14 is a perspective view showing the situation in which a capsule is discharged to the top surface of cap 30. The capsule 50 follows the slope 324 (formed on the lower side of the discharge port 322) from the upper side end of spiral groove 22, naturally tumbling down, and is discharged individually (i.e., one capsule at a time) to the top surface of the cap 30.

After the desired capsule (or desired number of capsules) has been discharged, the lid 70 is closed on the container and the container is stored or carried. As noted above, when lid 70 is coupled to receptacle 10, the second sealing ring 79 provided on the inner side of the lid is elastically in close contact with the sealing extension 39 formed on the top surface of the cap 30, and the first sealing ring 19 is in close contact with the inner periphery of the top of receptacle 10 and the outer periphery of second lower extending extension 36 of cap 30, and the inside of receptacle 10 is sealed.

It is to be understood that the invention is not limited to the features and embodiments hereinabove specifically set forth, but may be carried out in other ways without departure from its spirit.

What is claimed is:

1. A capsule container for storing plural capsules and discharging the stored capsules individually, comprising:

(a) an upwardly open container body including a receptacle portion for holding a plurality of capsules;

(b) a cap mounted on the container body for manual rotation relative thereto about a vertical axis and having a discharge port;

(c) an upright screw shaft disposed within and fixedly secured to the receptacle portion and having a circumferential spiral groove; and (d) a hollow cylinder coupled to the cap for rotation therewith, extending downwardly from the cap through the receptacle portion in surrounding concentric relation to the screw shaft, the cylinder having an inner surface bearing a screw thread facing the spiral groove, a lower part of the cylinder having an entry port through a wall of the cylinder for admitting stored capsules from the receptacle portion individually into the cylinder, the entry port rotatable with the cylinder, and the cylinder communicating upwardly with the discharge port, wherein the screw thread and the groove are coaxial and are mutually arranged and spaced apart to receive individual capsules admitted into the cylinder through the entry port, wherein the arrangement of the screw thread and groove form cavities sized to receive each capsule individually without crushing, and, upon rotation of the cap in a particular direction relative to the container body, to cause admitted capsules at the entry port to be raised one by one and not in contact with one another, from the entry port to the discharge port, and wherein a lower part of the circumferential spiral groove at least partially coincides with the entry port.

2. A capsule container as defined in claim 1, wherein the container body includes a main body portion joined to a lower part of the receptacle portion.

3. A capsule container as defined in claim 1, wherein the spiral groove and the screw thread have opposite senses of rotation.

4. A capsule container as defined in claim 1, wherein the screw shaft has an upper end exposed above the hollow cylinder.

5. A capsule container as defined in claim 1, wherein the hollow cylinder includes a capsule inflow guide protruding outwardly from the cylinder on one side of the entry port.

6. A capsule container as defined in claim 1, including a container lid, mountable over the cap.

7. A capsule container as defined in claim 1, including multiple first interlocking protrusions formed on the cap and multiple second interlocking protrusions formed on the cylinder for coupling with the multiple first interlocking protrusions so that the cylinder rotates with the cap.

8. A capsule container as defined in claim 1, including a first ratchet gear provided on the container body and a second ratchet gear provided on the cap, wherein the first and second gears interlock to restrict rotation of the cap about the vertical axis to said particular direction.

9. A capsule container as defined in claim 1, further comprising a capsule inflow guide protruding outwardly from one side of the entry port and an upper cover protruding outwardly from the top of the entry port.

10. A capsule container for storing plural capsules and discharging the stored capsules individually, comprising:

(a) an upwardly open container body including a receptacle portion for holding a plurality of capsules;

(b) a cap mounted on the container body for manual rotation relative thereto about a vertical axis and having a discharge port;

(c) an upright screw shaft disposed within and fixedly secured to the receptacle portion and having a circumferential spiral groove; and (d) a hollow cylinder coupled to the cap for rotation therewith, extending downwardly from the cap through the receptacle portion in surrounding concentric relation to the screw shaft, the cylinder having an inner surface bearing a screw thread facing the spiral groove, a lower part of the cylinder having an entry port through a wall of the cylinder for admitting stored capsules from the receptacle portion individually into the cylinder, the entry port rotatable with the cylinder, and the cylinder communicating upwardly with the discharge port, wherein the screw thread and the groove are coaxial and are mutually arranged to receive individual capsules admitted into the cylinder through the entry port, wherein the arrangement of the screw thread and groove form cavities sized to receive each capsule individually without crushing, and, upon rotation of the cap in a particular direction relative to the container body, to cause admitted capsules at the entry port to be raised one by one and not in contact with one another, from the entry port to the discharge port, and wherein a lower part of the circumferential spiral groove at least partially coincides with the entry port.

11. A capsule container as defined in claim 10, further comprising a capsule inflow guide protruding outwardly from one side of the entry port and an upper cover protruding outwardly from the top of the entry port.

* * * * *